US008948653B2

(12) United States Patent
Fukushima

(10) Patent No.: US 8,948,653 B2
(45) Date of Patent: Feb. 3, 2015

(54) IMAGE FORMING APPARATUS AND DEVELOPER CONTAINER

(71) Applicant: Tatsuo Fukushima, Osaka (JP)

(72) Inventor: Tatsuo Fukushima, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/094,930

(22) Filed: Dec. 3, 2013

(65) Prior Publication Data

US 2014/0161491 A1 Jun. 12, 2014

(30) Foreign Application Priority Data

Dec. 7, 2012 (JP) ..... 2012-268450

(51) Int. Cl.
*G03G 15/08* (2006.01)
*G03G 21/16* (2006.01)

(52) U.S. Cl.
CPC ..... *G03G 15/0886* (2013.01); *G03G 21/1633* (2013.01)
USPC ..... 399/120

(58) Field of Classification Search
CPC ..... G03G 15/0886; G03G 2215/0692
USPC ..... 399/110, 114, 120
See application file for complete search history.

(56) References Cited

U.S. PATENT DOCUMENTS 4,977,429 A 12/1990 Tani et al.
2012/0114373 A1 5/2012 Hamada et al.
2013/0170870 A1* 7/2013 Yoon et al. ..... 399/258
2013/0259532 A1 10/2013 Kubota et al.
2013/0266340 A1 10/2013 Hashimoto et al.
2013/0266347 A1 10/2013 Kubota et al.

FOREIGN PATENT DOCUMENTS

| | | |
|---|---|---|
| JP | 4-240878 | 8/1992 |
| JP | 2004-101578 | 4/2004 |
| JP | 2005-134452 | 5/2005 |
| JP | 2008-052033 | 3/2008 |
| JP | 2008-076887 | 4/2008 |
| JP | 2008-134526 | 6/2008 |
| JP | 2011-158507 | 8/2011 |

* cited by examiner

*Primary Examiner* — Clayton E Laballe
*Assistant Examiner* — Noam Reisner
(74) *Attorney, Agent, or Firm* — Oblon, Spivak, McClelland, Maier & Neustadt, L.L.P.

(57) ABSTRACT

An image forming apparatus includes an apparatus body, a developer container, an outlet, a first shutter, a cover member, a movable member, and a transmission member. The developer container is removably mountable relative to the apparatus body through an opening. The first shutter opens and closes the outlet. The cover member opens and closes the opening. The movable member is reciprocally movable in forward and reverse directions. The transmission member transmits action of the cover member to the movable member and is disposed between the cover member and the movable member. When the movable member is moved in the forward direction, the first shutter is closed. When the movable member is moved in the reverse direction, the first shutter is opened. In a terminal period of an opening operation of the cover member, a movement direction of the movable member is reversed from the forward direction to the reverse direction.

14 Claims, 24 Drawing Sheets

IMAGE FORMING APPARATUS AND DEVELOPER CONTAINER

CROSS-REFERENCE TO RELATED APPLICATIONS

This patent application is based on and claims priority pursuant to 35 U.S.C. §119 to Japanese Patent Application No. 2012-268450, filed on Dec. 7, 2012 in the Japan Patent Office, the entire disclosure of which is hereby incorporated by reference herein.

INCORPORATION BY REFERENCE

The entire disclosure of each of the following U.S. Patent Applications is hereby incorporated by reference herein:

U.S. patent application Ser. No. 13/907083, filed on May 31, 2013; and

U.S. patent application Ser. No. 13/908434, published on Jun. 3, 2013.

BACKGROUND

1. Technical Field

This disclosure relates to an image forming apparatus and a developer container.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. In such electrophotographic image forming apparatus, since toner serving as developer is consumed with image formation, tone is replenished so that toner in a developing device runs out. As one replenishment method, a method is known of replacing a used toner cartridge with a toner cartridge filled with toner. In replacement of toner cartridges, for example, an upper cover at an upper surface of an image forming apparatus is opened, a used toner cartridge in the apparatus is removed, and a new toner cartridge is installed to a predetermined position in the apparatus.

The toner cartridge has an outlet to supply toner to a developing device disposed in an apparatus body of the image forming apparatus. A shutter is provided with the outlet to open and close the outlet so that toner may not be scattered from the outlet when the toner cartridge is removed from the apparatus body. For example, when the toner cartridge is mounted on the apparatus body, the shutter is opened to open the outlet, thus allowing toner to be supplied to the developing device. By contrast, when the toner cartridge is removed from the apparatus body, the shutter is closed to close the outlet, thus preventing toner from being scattered from the outlet to the outside of the developing device.

For example, in a shutter opening-and-closing assembly to switch a state of a shutter between an open state and a closed state, opening and closing movements of an exterior cover may be used as driving force of the shutter. For example, JP-2008-052033-A proposes a configuration of opening and closing of a shutter. An input gear is mounted on an opening-and-closing shaft of an exterior cover and rotated forward and in reverse in response to opening and closing of a cover member. The rotation movement is transmitted to the shutter via a gear train to open and close the shutter.

For the shutter opening-and-closing assembly described in JP-2008-052033-A, the input gear is rotated in response to an opening-and-closing angle of the cover member. Accordingly, during opening operation of the cover member, the shutter is moved in one of the opening and closing directions. By contrast, during closing operation of the cover member, the shutter is moved in the other of the opening and closing directions. Consequently, the shutter or a member to drive the shutter has a relatively large stroke. Such a large stroke constrains the layout to avoid conflict with surrounding components.

BRIEF SUMMARY

In at least one exemplary embodiment of this disclosure, there is provided an image forming apparatus including a recording head, an ejection detector, and a cleaner. The recording head has a plurality of nozzles to eject droplets and a nozzle face in which the plurality of nozzles is formed. The ejection detector detects ejection or non-ejection of the droplets from the recording head. The ejection detector has an electrode member disposed in an area in which the electrode member is opposable to the recording head. The droplets ejected from the plurality of nozzles of the recording head land on the electrode member. The cleaner cleans the electrode member after ejection or non-ejection of the droplets from the plurality of nozzles is detected by detection of electric changes of the electrode member generated when the droplets ejected from the plurality of nozzles of the recording head land on the electrode member in a state in which a potential difference is created between the nozzle face of the recording head and the electrode member and the nozzle face of the recording head is opposed to the electrode member. The cleaner includes a wiping member to wipe the droplets adhering to the electrode member. The wiping member and the electrode member are configured to be relatively moved in parallel to a nozzle array direction in which the plurality of nozzles is arrayed, to clean the electrode member.

In at least one exemplary embodiment of this disclosure, there is provided an image forming apparatus including an apparatus body, a developer container, an outlet, a first shutter, a cover member, a movable member, and a transmission member. The apparatus body has an opening. The developer container contains developer and is removably mountable relative to the apparatus body through the opening. Through the outlet, the developer is discharged from the developer container to an outside of the developer container. The first shutter opens and closes the outlet. The cover member opens and closes the opening of the apparatus body. The movable member is reciprocally movable in forward and reverse directions. The transmission member transmits action of the cover member to the movable member and is disposed between the cover member and the movable member. When the movable member is moved in the forward direction, the first shutter is closed. When the movable member is moved in the reverse direction, the first shutter is opened. In a terminal period of an opening operation of the cover member, a movement direction of the movable member is reversed from the forward direction to the reverse direction.

In at least one exemplary embodiment of this disclosure, there is provided a developer container including a developer containing part, an outlet, and a first shutter. The developer containing part contains developer. Through the outlet, the developer is discharged from the developer containing part to an outside of the developer containing part. The first shutter opens and closes the outlet. The developer container is mountable and removable relative to an apparatus body of an image forming apparatus through an opening of the apparatus body. The image forming apparatus includes a cover member to open and close the opening of the apparatus body, a movable member reciprocally movable in forward and reverse directions, and a transmission member to connect the cover member to the movable member. When the movable member is moved in the forward direction, the first shutter is closed. When the movable member is moved in the reverse direction, the first shutter is opened. A movement direction of the movable member is reversed from the forward direction to the reverse direction in a terminal period of an opening operation of the cover member, and the first shutter is maintained in a closed state while the movable member is moved in the reverse direction after the movement direction is reversed.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
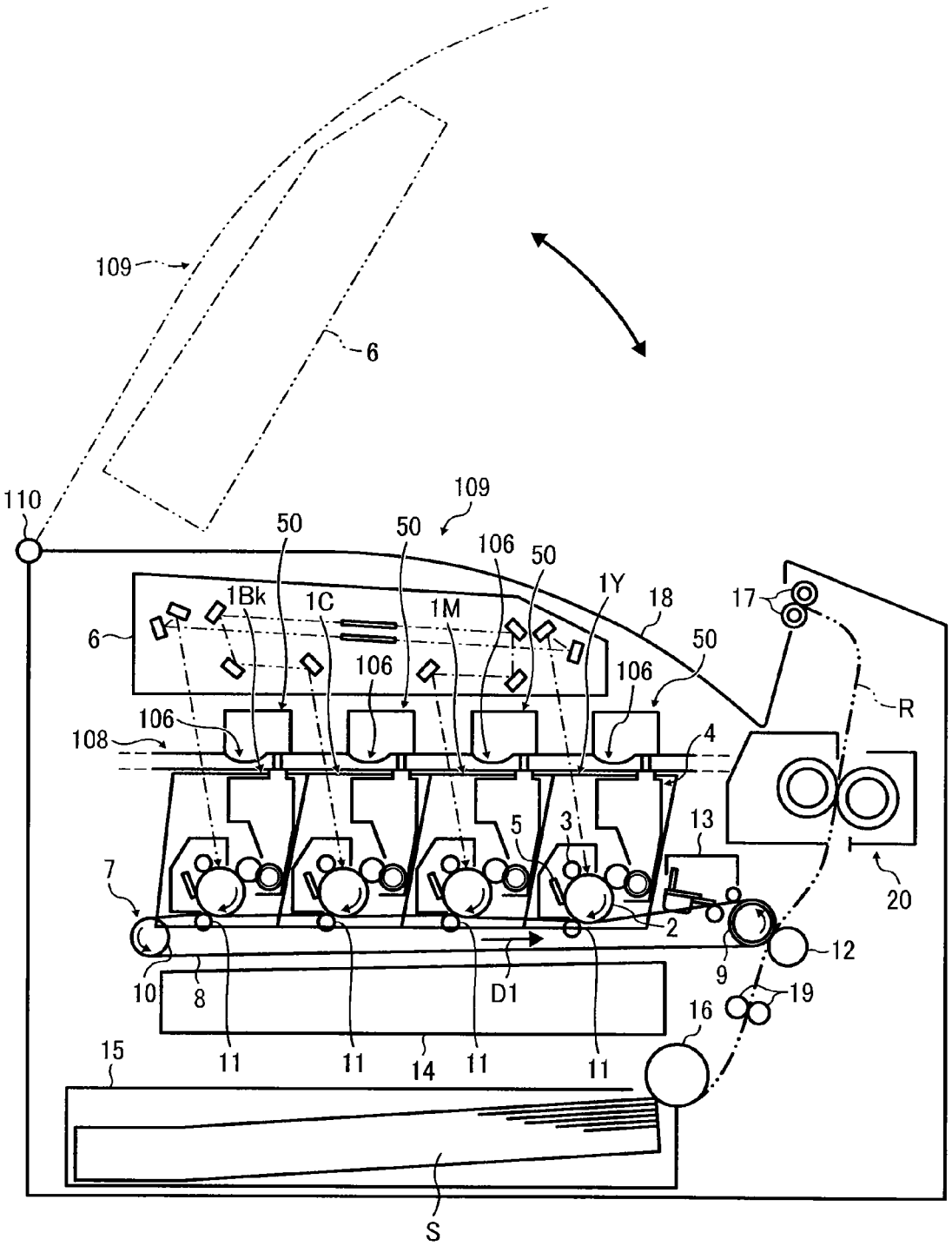
FIG. 1 is a cross-sectional view of a schematic configuration of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

First, a general configuration and operation of a color laser printer serving as an image forming apparatus according to an exemplary embodiment of the present disclosure are described with reference to FIG. 1.

It is to be noted that the image forming apparatus is not limited to the color laser printer but, in some embodiments, is any other type of image forming apparatus. The image forming apparatus may be, for example, a monochromatic printer, other type of printer, a copier, a facsimile machine, or a multi-functional periphery having at least one of the foregoing capabilities.

As shown in FIG. 1, the image forming apparatus has an apparatus body (image forming apparatus body) 100. Four process units 1Y, 1M, 1C, and 1Bk serving as image forming units are removably mounted in the apparatus body 100. The process units 1Y, 1M, 1C, and 1Bk have substantially the same configurations except for accommodating developing agents of different colors, i.e., yellow (Y), magenta (M), cyan (C), and black (Bk) corresponding to different color separation components of a color image.

Specifically, each of the process units 1Y, 1M, 1C, and 1Bk includes, for example, a photoreceptor 2, a charging device, a developing device 4, and a cleaning device 5. The photoreceptor 2 has, for example, a drum shape and serves as a latent image carrier. The charging device includes, for example, a charging roller 3 to charge a surface of the photoreceptor 2. The developing device 4 supplies developer to a latent image on the photoreceptor 2. The cleaning device 5 has, for example, a cleaning blade to clean the surface of the photoreceptor 2. It is to be noted that, in FIG. 1, reference numerals of the photoreceptor 2, the charging roller 3, the developing device 4, and the cleaning device 5 are allocated only to the process unit 1Y and the reference numerals of the photoreceptors 2, the charging rollers 3, the developing devices 4, and the cleaning devices 5 of the other process units 1M, 1C, and 1Bk are omitted for simplicity. The image forming apparatus illustrated in FIG. 1 uses one-component developer consisting of toner as developer. However, the developer is not limited to the one-component developer but may be, for example, two-component developer consisting of toner and carrier. In other words, the term "developer" used herein means, for example, toner as one-component developer and a mixture of toner and carrier particles as two-component developer.

Above the developing devices 4 of the process units 1Y, 1M, 1C, and 1Bk are disposed toner cartridges 50 serving as developer containers to contain toner to be replenished to the developing devices 4. In FIG. 1, a separator 108 is disposed between the developing devices 4 and the toner cartridges 50. The separator 108 forms a base member 107 and has four mount portions 106 to removably mount the corresponding toner cartridges 50.

In an upper area of the toner cartridges 50 is disposed an exposing device 6 to expose the surfaces of the photoreceptors 2 of the process units 1Y, 1M, 1C, and 1Bk. The exposing device 6 includes, for example, light sources, polygon mirrors, f-θ lenses, reflection mirrors to irradiate laser light onto the surfaces of the photoreceptors 2 according to image data.

An upper cover 109 serving as a cover member is disposed at an upper portion of an apparatus body 100. The upper cover 109 pivots around a cover shaft 110 so as to open and close in upward and downward directions. The exposing device 6 is mounted to the upper cover 109. As a result, when the upper cover 109 is opened, the exposing device 6 is retracted from the upper area of the toner cartridges 50. In a state in which the exposing device 6 is retracted, the toner cartridges 50 can be removed from an upper opening 111 of the apparatus body 100.

A transfer device 7 is disposed below the process units 1Y, 1M, 1C, and 1Bk. The transfer device 7 has an intermediate transfer belt 8 formed of an endless belt serving as a transfer body. The intermediate transfer belt 8 extends between a driving roller 9 and a follow roller 10, and when the driving roller 9 is rotated counterclockwise in FIG. 1, the intermediate transfer belt 8 is circulated (rotated) in a direction indicated by an arrow D1 in FIG. 1.

Four primary transfer rollers 11 serving as primary transfer devices are disposed at positions opposing the four photoreceptors 2. The primary transfer rollers 11 press an inner circumferential surfaces of the intermediate transfer belt 8 at the respective opposing positions, and primary transfer nips are formed at points at which pressed portions of the intermediate transfer belt 8 contact the photoreceptors 2. The primary transfer rollers 11 are connected to power sources, and predetermined direct current (DC) voltage and/or alternating current (AC) voltage are supplied to the primary transfer rollers 11.

A secondary transfer roller 12 serving as a secondary transfer device is disposed at a position opposing the driving roller 9. The secondary transfer roller 12 presses an outer circumferential surface of the intermediate transfer belt 8, and a secondary transfer nip is formed at a position at which the secondary transfer roller 12 contacts the intermediate transfer belt 8. Similarly with the primary transfer rollers 11, the secondary transfer roller 12 is connected to a power source, and predetermined direct current (DC) voltage and/or alternating current (AC) voltage are supplied to the secondary transfer roller 12.

At a right end (in FIG. 1) of the outer circumferential surface of the intermediate transfer belt 8, a belt cleaning device 13 is disposed to clean the surface of the intermediate transfer belt 8. A waste-toner transport hose extending from the belt cleaning device 13 is connected to an inlet of a waste-toner container 14 disposed below the transfer device 7.

Below the apparatus body 100 is disposed a feed tray 15 to accommodate recording media S. The feed tray 15 has a feed roller 16 to feed the recording media S accommodated in the feed tray 15. Above the apparatus body 100 is disposed a pair of output rollers 17 to output the recording media S to an outside of the apparatus body 100. The upper cover 109 is provided with an output tray 18 to stack the recording media S output by the pair of output rollers 17. The recording media used herein includes not only plain sheets of paper, for example, paperboards, envelopes, coated paper (or art paper), tracing paper, and overhead projector (OHP) sheets.

The apparatus body 100 includes a transport path R to transport the recording media S from the feed tray 15 to the output tray 18 through the secondary transfer nip. At a position upstream from the secondary transfer roller 12 in a transport direction of a recording medium S on the transport path R, a pair of registration rollers 19 serving as a transport device is disposed to transport the recording medium S to the secondary transfer nip at a proper transport timing. A fixing device 20 is disposed at a position downstream from the secondary transfer roller 12 in the transport direction.

The above-described image forming apparatus operates, for example, as follow. When an imaging operation is started, the photoreceptors 2 of the process units 1Y, 1M, 1C, and 1Bk are rotated clockwise in FIG. 1 and a surface of each photoreceptor 2 is uniformly charged with a predetermined polarity by the charging roller 3. Based on image information of a document read by an image reading device, the exposing device 6 irradiates a laser light onto the charged surface of each photoreceptor 2 to form an electrostatic latent image on the surface of each photoreceptor 2. At this time, image information exposed to each photoreceptor 2 is single-color image information formed by separating a desired full color image into each of yellow, magenta, cyan, and black color information. As described above, each developing device 4 supplies toner onto the electrostatic latent image to make the electrostatic latent images visible as a toner image.

Subsequently, the driving roller 9 extending taut the intermediate transfer belt 8 is rotated to circulate the intermediate transfer belt 8 in the direction indicated by the arrow D1 in FIG. 1. A voltage having a polarity opposite a charged polarity of toner is controlled so as to maintain a constant voltage or current, and supplied to each primary transfer roller 11. As a result, a transfer electric field is formed at each primary transfer nip between each primary transfer roller 11 and the corresponding photoreceptor 2. By the transfer electric fields formed at the primary transfer nips, toner images of the respective colors on the photoreceptors 2 are transferred one on another onto the intermediate transfer belt 8. Thus, the intermediate transfer belt 8 bears a full-color toner image on the surface thereof. Residual toner remaining on each photoreceptor 2 without being transferred onto the intermediate transfer belt 8 is removed by the cleaning blade of the cleaning device 5.

In the feed tray 15, the feed roller 16 is rotated to feed a recording medium S from the sheet feed tray 15 to the transport path R. The recording medium S fed to the transport path R is further fed to the secondary transfer nip between the secondary transfer roller 12 and the intermediate transfer belt 8 by the pair of registration rollers 19 at a proper timing. At this time, the secondary transfer roller 12 is supplied with a transfer voltage having a polarity opposite a charged polarity of toner forming the full-color toner image on the intermediate transfer belt 8. As a result, a transfer electric field is formed at the secondary transfer nip. By the transfer electric field formed at the secondary transfer nip, the full-color toner image on the intermediate transfer belt 8 is collectively transferred onto the recording medium S. In addition, residual toner remaining on the intermediate transfer belt 8 after the secondary transfer is removed by the belt cleaning device 13, and removed toner is sent and collected into the waste-toner container 14.

Then, the recording medium S having the full-color toner image transferred thereon is transported to the fixing device 20, and the fixing device 20 fixes the full-color toner image on the recording medium S. The recording medium S is output to the outside of the apparatus body 100 by the pair of output rollers 17 and stacked on the output tray 18.

The above description relates to image forming operation for forming a full color image on a recording medium. In other image forming operation, a single color image can be formed by any one of the process units 1Y, 1M, 1C, and 1Bk, or a composite color image of two or three colors can be formed by two or three of the process units 1Y, 1M, 1C, and 1Bk.

Figure 2:
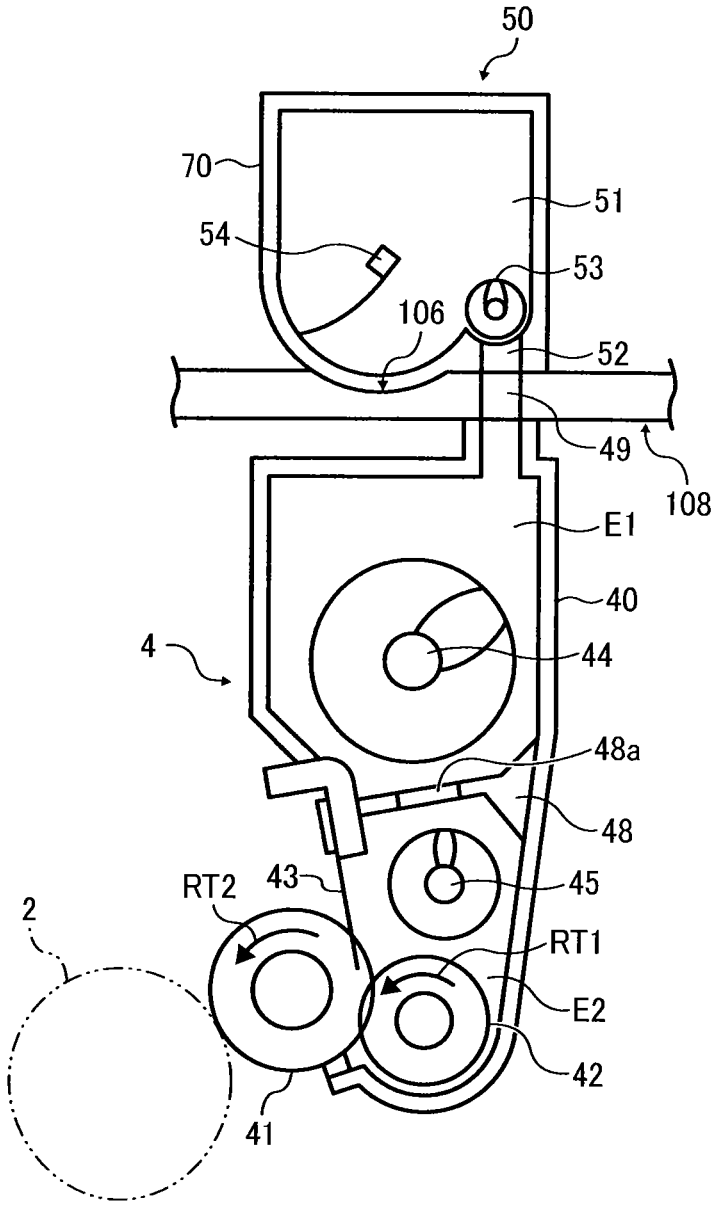
FIG. 2 is a cross-sectional view of a schematic configuration of a developing device and a toner cartridge of the image forming apparatus.

As illustrated in FIG. 2, each of the developing devices 4 has a development housing 40 to accommodate toner, a developing roller 41 serving as a developer carrier to carry toner, a supply roller 42 serving as a developer supply member to supply toner onto the developing roller 41, a developing blade 43 serving as a regulation member to regulate the amount of toner on the developing roller 41, and two conveyance screws 44 and 45 serving as conveying members to covey toner.

An interior of the development housing 40 is divided into a first compartment E1 at an upper side and a second compartment E2 at a lower side in FIG. 2 by a partition wall 48 having communication ports 48*a*. The communication ports 48*a* are disposed at opposed ends of the partition wall 48 (at front and rear sides in a direction perpendicular to a surface of a sheet on which FIG. 2 is printed). In other words, the first compartment E1 and the second compartment E2 are communicated with each other at positions at which the communication ports 48*a* are formed.

In the first compartment E1 is disposed the conveyance screw 44. In the second compartment E2 are disposed the conveying screw 45 and the supply roller 42. The conveying screw 45 conveys toner in a direction opposite a direction in which the conveyance screw 44 conveys toner. At an opening of the second compartment E2 opposing the photoreceptor 2 are disposed the developing roller 41 and the developing blade 43. The supply roller 42 contacts the developing roller 41 to form a nipping portion. By rotating the supply roller 42 in a counter direction (indicated by an arrow RT1 in FIG. 2) relative to a rotation direction of the developing roller 41 (indicated by an arrow RT2 in FIG. 2), toner in the development housing 40 is supplied to the developing roller 41. The developing roller 41 conveys developer retained on a surface thereof to respective positions opposing the developing blade 43 and the photoreceptor 2.

When toner borne on the developing roller 41 passes a nipping portion between the developing roller 41 and the developing blade 43, the thickness of a layer of toner is regulated and, simultaneously toner is charged by friction. When toner on the developing roller 41 is conveyed to the position (developing area) opposing the photoreceptor 2, toner is electrostatically transferred onto an electrostatic latent image on the photoreceptor 2 to form a toner image.

The toner cartridges 50 serving as a developer container has a container body 70 including a developer containing part 51 to contain toner. The container body 70 has, for example, an outlet 52, a conveyance screw 53, and an agitator 54. Through the outlet 52, toner is discharged from the developer containing part 51 to an outside of the container body 70. The conveyance screw 53 serves as a conveyance member to convey toner in the developer containing part 51 to the outlet 52. The agitator 54 serves as an agitating member to agitate developer in the developer containing part 51. The outlet 52 is provided at a lower position of the developer containing part 51. At each of the mount portions 106 of the separator 108 to mount the toner cartridges 50 is formed a replenishment port 49 connected to the outlet 52 of the toner cartridges 50.

The toner cartridge 50 of FIG. 2 is removably mounted to the apparatus body 100 as a single unit provided separately from the process units 1Y, 1M, 1C, and 1Bk. However, it is to be noted that the configuration of the toner cartridge is not limited to the above-described configuration. In some embodiments, for example, the toner cartridge 50 is an integral part of a process unit including the photoreceptor 2, the charging device 3, the developing device 4, and the cleaning device 5 so that the process unit including the toner cartridge 50 is removably mountable relative to the apparatus body 100 as a single unit. Alternatively, in some embodiments, the toner cartridge 50 is an integral part of the developing device 4 to form a developing unit, and the developing unit is removably mountable relative to the apparatus body 100.

Next, toner replenishment operation on the developing device 4 is described below.

Replenishment of toner to the developing device 4 is performed when the amount of toner in the development housing 40 is not greater than a threshold value. When the amount of toner in the development housing 40 is not greater than the threshold value, the conveyance screw 53 and the agitator 54 in the toner cartridges 50 start rotating. Rotation of the conveyance screw 53 conveys toner to the outlet 52, and toner is replenished from the outlet 52 into the first compartment E1 of the development housing 40. In addition, when the agitator 54 is rotated, toner is agitated in the toner cartridges 50 and delivered to a rotation area of the conveyance screw 53. When the amount of toner in the development housing 40 is greater than a predetermined threshold value, rotation of the conveyance screw 53 and the agitator 54 is stopped and replenishment of toner ends.

In the developing device 4, when toner is replenished, the conveyance screw 44 in the first compartment E1 and the conveying screw 45 in the second compartment E2 are rotated. As a result, toner in the first compartment E1 is conveyed in a direction opposite a direction in which toner in the second compartment E2 is conveyed. When toner is conveyed to a downstream end of each of the first compartment E1 and the second compartments E2 in the conveyance direction, toner passes through one of the communication ports 48*a* formed at the opposed ends of the partition wall 48 and is delivered into the other of the first compartment E1 and the second compartments E2 (i.e., from the first compartment E1 to the second compartment E2 or from the second compartment E2 to the first compartment E1). Toner delivered into the other component is conveyed by the conveyance screw 44 or 45 in the other component and returned into the original one of the first compartment E1 and the second compartment E2 thorough the other of the communication ports 48*a*. By repeating the above-described operation, toner is circulated between the first compartment E1 and the second compartment E2. As a result, newly replenished toner is mixed with toner in the development housing 40, a uniform state of toner (uniform rate of newly replenished toner in the entire toner) is created, thus preventing occurrence of a failure, such as uneven distribution of color or background stain.

Figure 3:
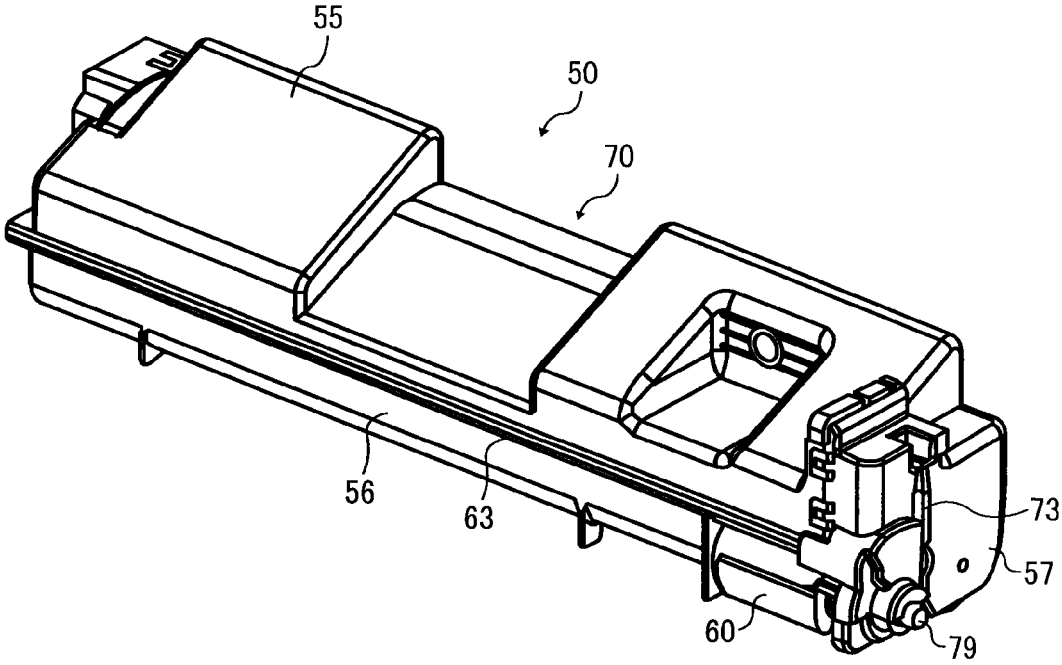
FIG. 3 is a perspective view of the toner cartridge.

FIG. 3 is an external perspective view of the toner cartridge 50.

As illustrated in FIG. 3, the toner cartridge 50 has the container body 70, a gear cover 57, and a shutter 60. The container body 70 includes an upper case 55 and a lower case 56. The gear cover 57 covers a side face of one end in a longitudinal direction of the container body 70. The shutter 60 is disposed at the same end of the container body 70. The container body 70 is produced by bonding rims of openings of the upper case 55 and the lower case 56 each other by, e.g., welding or adhesion. In an internal space of the container body 70 are accommodated toner, the conveyance screw 53, and the agitator 54. In the gear cover 57 is disposed a plurality of gears serving as torque transmitters to transmit driving force from the apparatus body to the conveyance screw 53 and the agitator 54.

At one end of the container body 70 in the longitudinal direction is disposed an outer shutter 60 serving as a second shutter to open and close the outlet 52. The outer shutter 60 is rotatable along an outer circumferential surface of a cylindrical portion of the container body 70 and movable between an open position at which the outlet 52 shown in FIG. 2 is open and a closed position at which the outlet 52 is closed.

Figure 4:
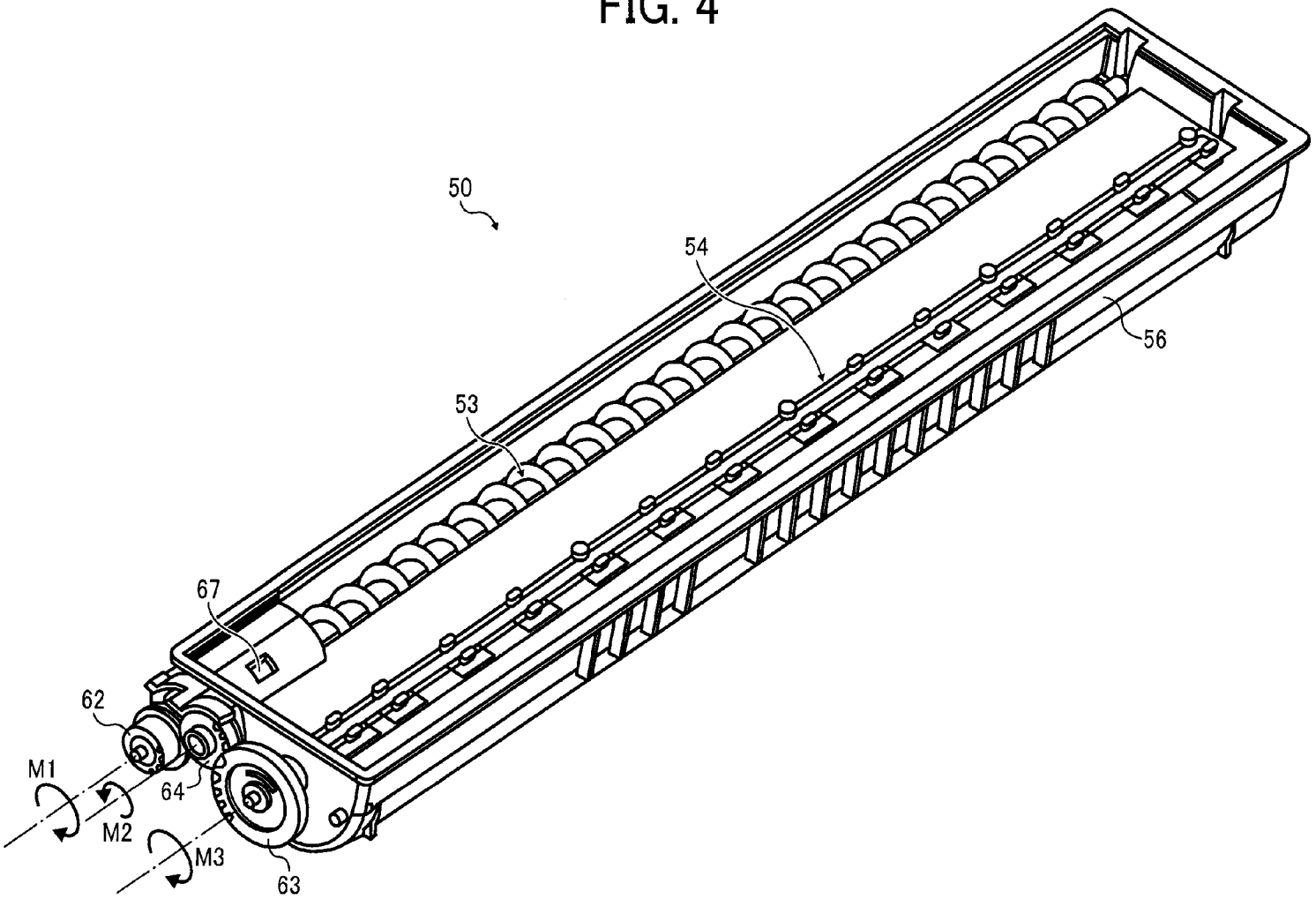
FIG. 4 is a perspective view of the toner cartridge in a state in which an upper case and a gear cover are removed from the toner cartridge.

FIG. 4 is a perspective view of the toner cartridges 50 in a state in which the upper case 55 and the gear cover 57 are removed from the toner cartridges 50. A conveyance driving gear 62, an agitation driving gear 63, and a torque transmission gear 64 illustrated in FIG. 4 are accommodated in the gear cover 57. The conveyance driving gear 62 and the agitation driving gear 63 are mounted on respective rotation shafts of the conveyance screw 53 and the agitator 54 that protrude beyond a side face of the lower case 56 to the outside of the lower case 56. The torque transmission gear 64 engages the conveyance driving gear 62 and the agitation driving gear 63 to transmit rotation torque.

Figure 11:
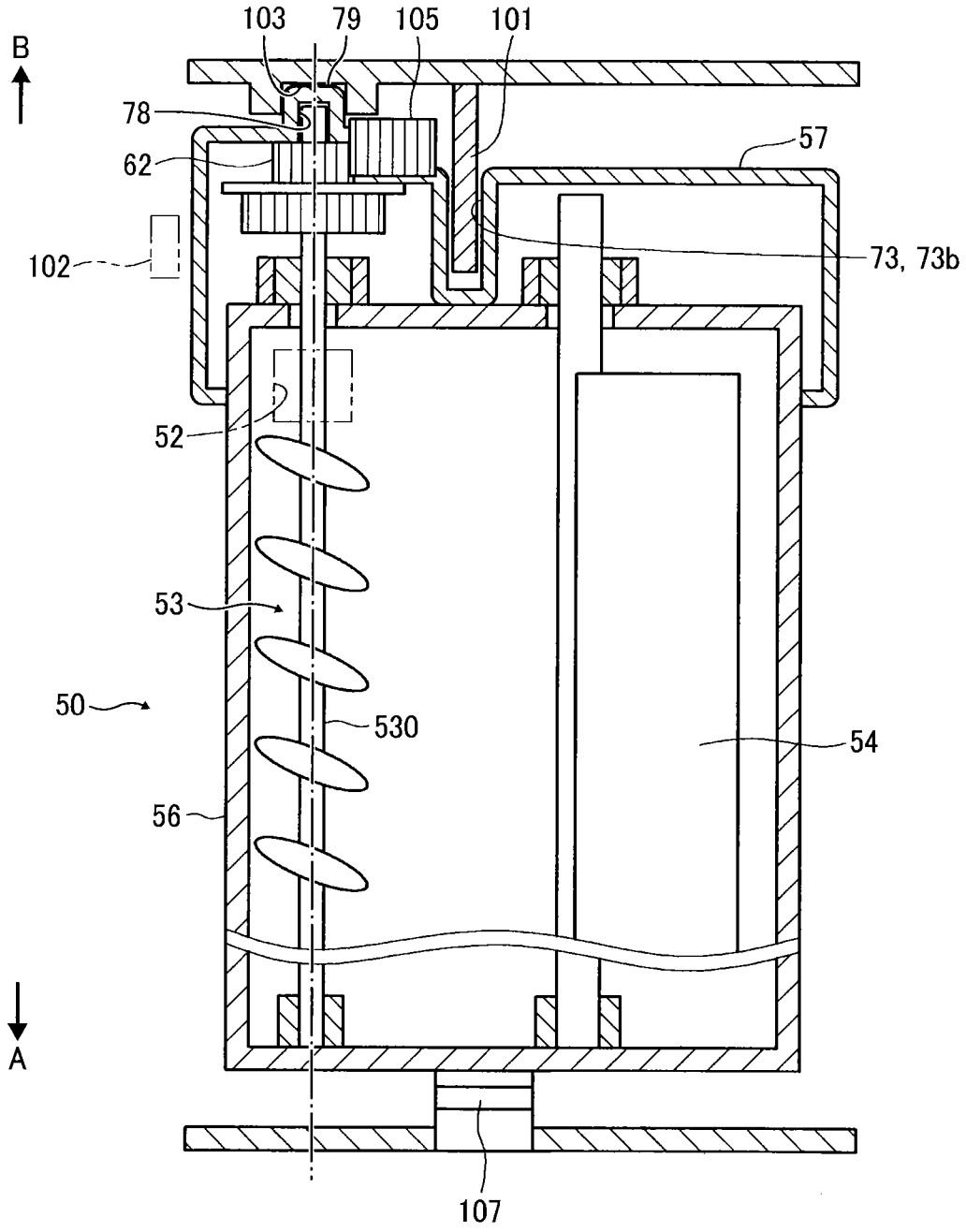
FIG. 11 is a cross-sectional view of the toner cartridge mounted on an apparatus body, seen from below the toner cartridge.

The apparatus body 100 is mounted with a body-side driving gear 105 (FIGS. 11 and 12). When the toner cartridges 50 is mounted on the mount portions 106 of the apparatus body 100, the conveyance driving gear 62 engages the body-side driving gear 105. In this state, when the body-side driving gear 105 is rotated, the conveyance driving gear 62, the torque transmission gear 64, and the agitation driving gear 63 are rotated in directions indicated by arrows M1, M2, and M3 in FIG. 4, thus rotating the conveyance screw 53 and the agitator 54. The conveyance driving gear 62 of FIG. 4 is a two-step gear having a larger-diameter gear part and a smaller-diameter gear part. The torque transmission gear 64 engages the larger-diameter gear part and the body-side driving gear 105 engages the smaller-diameter gear part.

Figure 5:
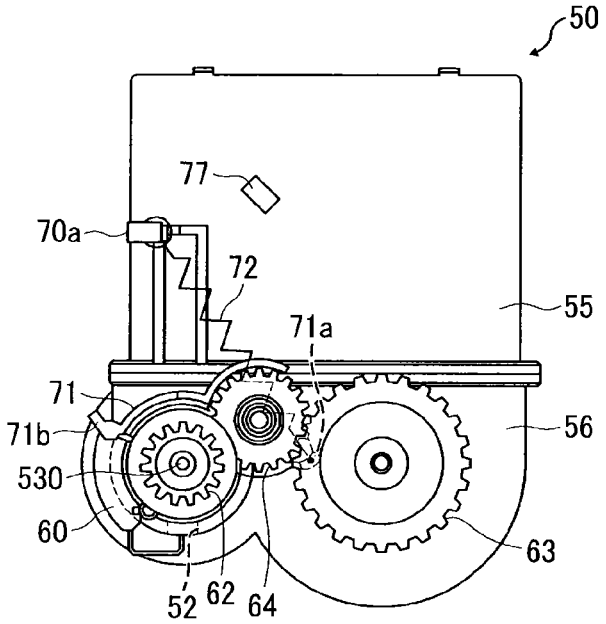
FIG. 5 is a side view of the toner cartridge in a state in which the gear cover is removed from the toner cartridge.
Figure 6:
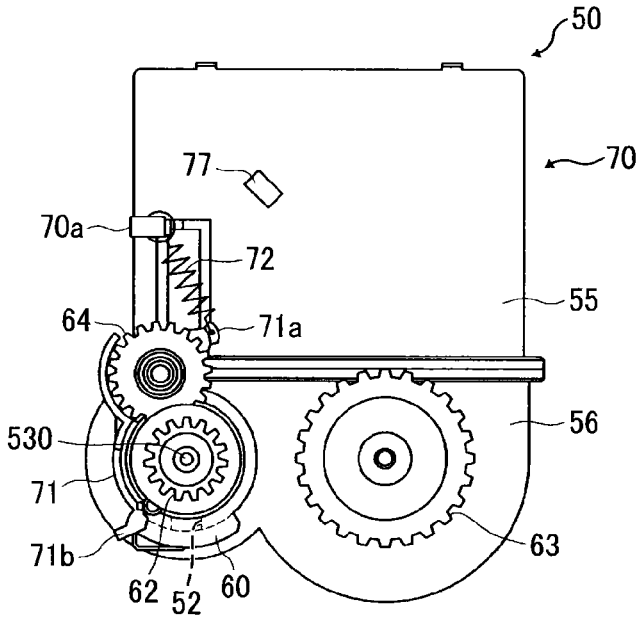
FIG. 6 is a side view of the toner cartridge in the state in which the gear cover is removed.
Figure 7:
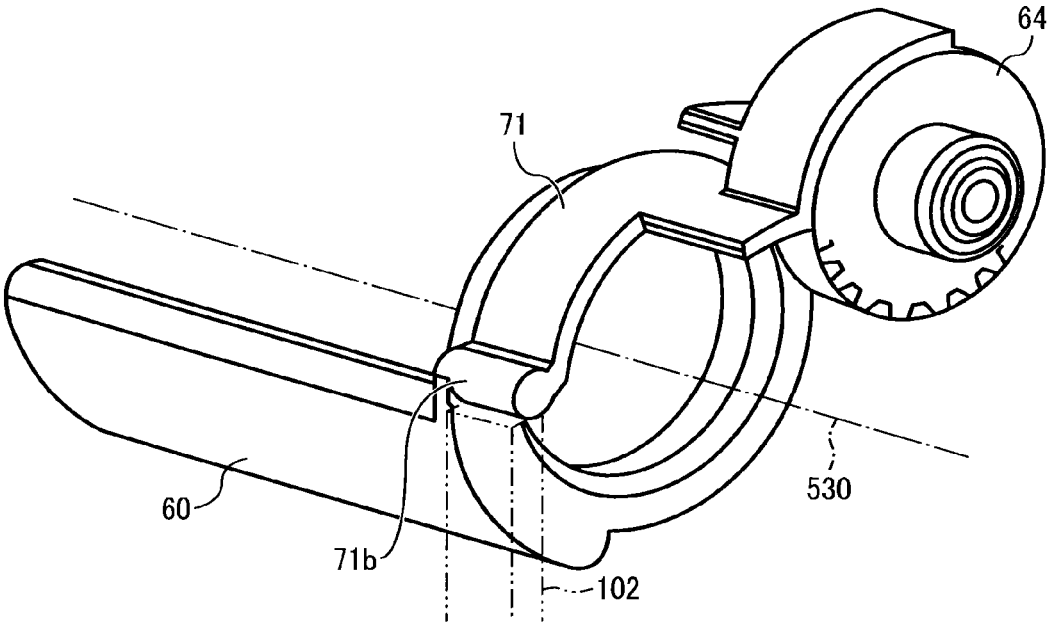
FIG. 7 is a perspective view of the gear holder.

FIGS. 5 and 6 are side views of the toner cartridges 50 in a state in which the gear cover 57 is removed from the toner cartridges 50. As illustrated in FIG. 5, the torque transmission gear 64 is movable between an operating position and a retracted position. At the operating position, the torque transmission gear 64 engages the conveyance driving gear 62 and the agitation driving gear 63 to transmit torque. At the retracted position, the torque transmission gear 64 is disengaged from the conveyance driving gear 62 and the agitation driving gear 63. Specifically, as illustrated in FIG. 7, the torque transmission gear 64 is held by a gear holder 71 that is supported so as to be rotatable around a rotation shaft 530 of the conveyance screw 53 (or the rotation shaft 530). When the gear holder 71 is rotated in a forward or reverse direction, the position of the torque transmission gear 64 is shifted between the operating position illustrated in FIG. 5 and the retracted position illustrated in FIG. 6.

As illustrated in FIG. 7, the outer shutter 60 serving as the second shutter is an integral part of the gear holder 71. When the gear holder 71 is rotated around the rotation shaft 530, the outer shutter 60 is rotated around the rotation shaft 530 of the conveyance screw 53 with the rotation of the gear holder 71. In such a case, as illustrated in FIG. 5, in a state in which the torque transmission gear 64 is at the operating position, the outlet 52 is opened by the outer shutter 60. As illustrated in FIG. 6, in a state in which the torque transmission gear 64 is at the retracted position, the outlet 52 is closed by the outer shutter 60.

As illustrated in FIGS. 5 and 6, a tension spring 72 is disposed between the gear holder 71 and the container body 70. One end of the tension spring 72 is hooked to a stopper 71*a* of the gear holder 71, and the other end of the tension spring 72 is attached to a stopper 70*a* that is disposed on the side face of the upper case 55. By the tension (urging force) of the tension spring 72, the gear holder 71 is urged in such a direction that the torque transmission gear 64 moves away from the agitation driving gear 63. Thus, in a state in which no external force is applied to the gear holder 71, as illustrated in FIG. 6, the torque transmission gear 64 is shifted to the retracted position by the tension of the tension spring 72.

As illustrated in FIG. 7, the gear holder 71 has an operation part (or gear holder protrusion) 71*b*. When the toner cartridges 50 is mounted on the mount portions 106 of the apparatus body 100, the operation part 71*b* contacts an upper end of a shutter regulation member 102 disposed at the apparatus body 100. When the toner cartridges 50 is removed from the apparatus body 100, the operation part 71*b* is detached from the shutter regulation member 102.

Figure 8:
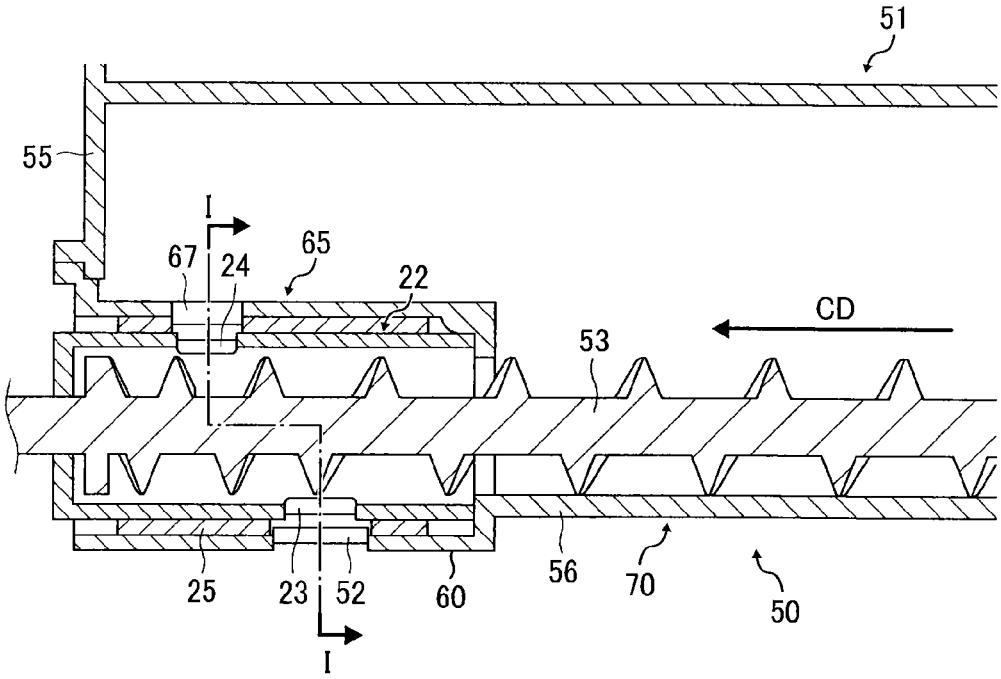
FIG. 8 is a cross-sectional view of the toner cartridge cut along an axial direction thereof at a position of a conveyance screw.

FIG. 8 is a cross-sectional view of the toner cartridge 50 cut along an axial direction thereof at a position of the conveyance screw 53.

As illustrated in FIG. 8, the toner cartridge 50 employs a double shutter structure having an inner shutter 22 serving as a first shutter and the above-described outer shutter 60 serving as the second shutter. The inner shutter 22 and the outer shutter 60 are arranged so as to overlap in a diameter direction. The outer shutter 60 opens and closes an outer opening of the outlet 52, and the inner shutter 22 opens and closes an inner opening of the outlet 52.

The inner shutter 22 is cylindrical and has a developer outlet 23 at a peripheral wall thereof. By rotation of the inner shutter 22 around a center of a shaft thereof, the developer outlet 23 is switchable between an open state and a closed state. At the open state, the developer outlet 23 overlaps the outlet 52. At the closed state, the peripheral wall of the inner shutter 22 overlaps the outlet 52 (and the developer outlet 23 does not overlap the outlet 52). The conveyance screw 53 is inserted into an inner-diameter part of the inner shutter 22.

The inner shutter 22 has a return port 24 to return toner, which has not been discharged from the outlet 52 via the developer outlet 23, from the inside of the inner shutter 22 to the inside of the developer containing part 51. The return port 24 is disposed at a position downstream from the developer outlet 23 in a conveyance direction of toner indicated by an arrow CD in FIG. 8.

At an outer-diameter side of the inner shutter 22, an eave portion 65 of a half-cylindrical shape. The inner shutter 22 is rotatably held between the eave portion 65 and an inner wall surface of the container body 70.

Without the eave portion 65, it may be possible to rotatably support one end of the inner shutter 22 by the container body 70 in a single support manner. However, an inner cylindrical surface of the eave portion 65 acts as a bearing, thus stabilizing the rotational posture of the inner shutter 22. The eave portion 65 has a return port 67 at a position corresponding to the return port 24 of the inner shutter 22.

A seal member 25 of a cylindrical shape is disposed between the outer circumferential surface of the inner shutter 22 and an inner circumferential surface of the eave portion 65 and between the outer circumferential surface of the eave portion 65 and the inner wall surface of the container body 70 to prevent toner from leaking from between the outer circumferential surface of the inner shutter 22 and the inner circumferential surface of the eave portion 65 and between the outer circumferential surface of the eave portion 65 and the inner wall surface of the container body 70.

Figure 9A:
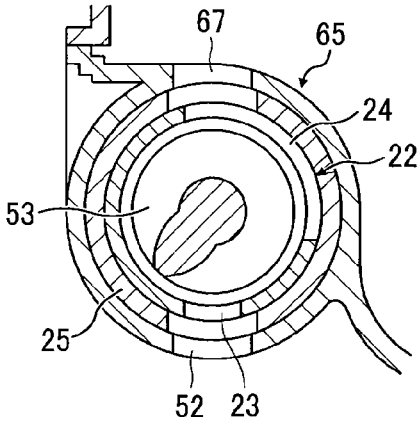
FIG. 9A is a cross-sectional view of a portion of the toner cartridge near an outlet in an open state.
Figure 9B:
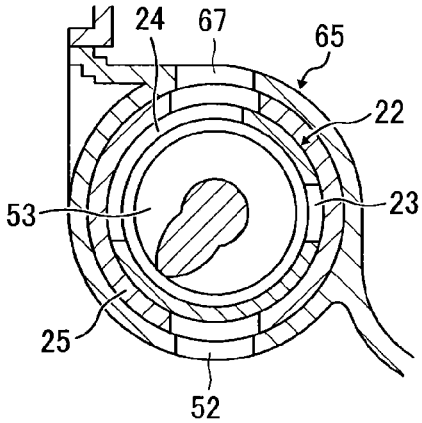
FIG. 9B is a cross-sectional view of the portion of the toner cartridge near the outlet in a closed state.

FIG. 9A is a cross-sectional view of the toner cartridge 50 cut along a I-I line of FIG. 8 in the open state in which the developer outlet 23 of the inner shutter 22 overlaps the outlet 52. By contrast. FIG. 9B is a cross-sectional view of the toner cartridge 50 cut along the I-I line of FIG. 8 in the closed state in which the developer outlet 23 does not overlap the outlet 52. As illustrated in FIG. 10A, the return port 24 of the inner shutter 22 is formed so as to extend along the circumferential direction of the inner shutter 22, and the return port 24 is more largely open in the circumferential direction than the developer outlet 23. By forming the return port 24 of the inner shutter 22 as described above, a part of the return port 24 of the inner shutter 22 overlaps the return port 67 of the eave portion 65 in any of the open state shown in FIG. 9A and the closed state shown in FIG. 9B.

Figure 10:
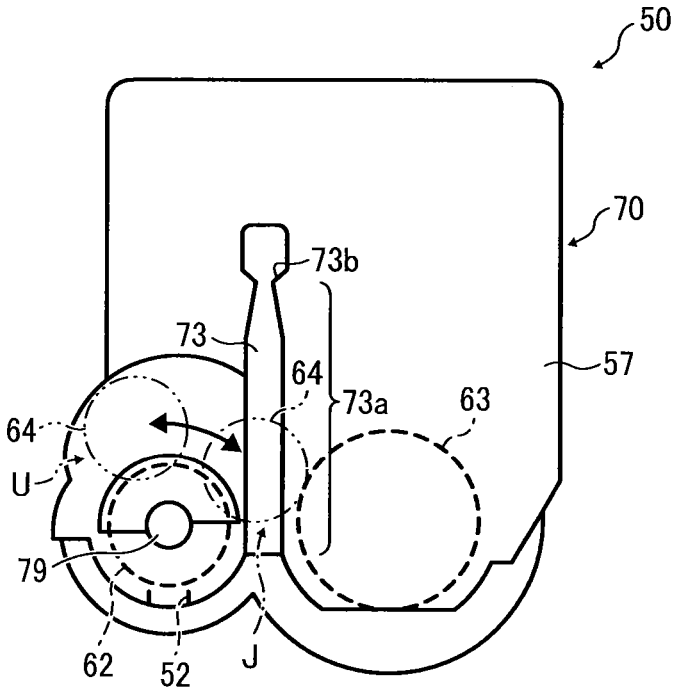
FIG. 10 is a side view of the toner cartridge seen from the gear cover.

FIG. 10 is a side view of the toner cartridges 50 seen from a side on which the gear cover 57 is disposed. FIG. 11 is a cross-sectional view of the toner cartridge 50 mounted on the apparatus body 100, seen from a bottom side of the toner cartridge 50.

As illustrated in FIGS. 10 and 11, an outer surface of the gear cover 57 has a slit 73 extending in an upward and downward direction (see also FIG. 3). Each of the mount portions 106 of the apparatus body 100 has a protrusion 101 protruding in a horizontal direction. When the toner cartridges 50 are installed to the apparatus body 100, the protrusion 101 is inserted into the slit 73. Conjunction of the slit 73 and the protrusion 101 provides a function of guiding the container body 70 along attachment and detachment directions relative to the apparatus body 100 and a function of positioning the container body 70 relative to the apparatus body 100. Specifically, the slip 73 has a guide portion 73*a* having the guiding function and a positioning portion 73*b* having the positioning function. The guide portion 73*a* ranges from a lower end to a portion just below an upper narrowest portion. The guide portion 73*a* is the upper narrowest portion. The lower end of the guide portion 73*a* is open downward. The guide portion 73*a* has a uniform width except for an upper end, and the width of the upper end gradually decreases toward the positioning portion 73*b*.

In FIG. 10, projection areas of the conveyance driving gear 62, the agitation driving gear 63, and the torque transmission gear 64 on an outer surface of the gear cover 57 having the slit 73 are shown by broken lines. An area J is a projection area of the torque transmission gear 64 placed at the operating position, and an area U is a projection area of the torque transmission gear 64 placed at the retracted position. As described above, in the toner cartridge 50 shown in FIG. 10, a portion of the guide portion 73*a* of the slit 73 is disposed in the projection area J of the torque transmission gear 64 placed at the operating position. In some exemplary embodiments, the entire guide portion 73*a* is disposed in the projection area J of the torque transmission gear 64 placed at the operating position. By contrast, the narrower positioning portion 73*b* of the slit 73 is disposed outside the projection area J of the torque transmission gear 64 placed at the operating position.

As illustrated in FIGS. 10 and 11, a convex portion 79 (see FIG. 3) serving as another guide portion and positioning portion is disposed at the outer side of the gear cover 57. The convex portion 79 is formed by molding a portion of the outer circumferential surface of the gear cover 57 in a cylindrical shape. The convex portion 79 is inserted into a guide slit 103 of the apparatus body 100. Conjunction of the convex portion 79 and the guide slit 103 provides a function of guiding the container body 70 along upward and downward directions relative to the apparatus body 100 and a function of positioning the container body 70 relative to the apparatus body 100. As described above, for the toner cartridge shown in FIG. 11, the container body 70 is positioned relative to the apparatus body 100 at two points, i.e., the positioning portion 73*b* of the slit 73 and the convex portion 79.

On a back surface of the gear cover 57 and a back side of the (container-side) positioning portion 73*b* of the slit 73, a positioning boss is disposed so as to protrude. When the gear cover 57 is mounted onto each of an upper case 55 and a lower case 56, the boss is inserted into a long hole 77 (see FIGS. 5 and 6) formed at a side face of the upper case 55. Thus, the gear cover 57 is positioned relative to the upper case 55.

As illustrated in FIG. 11, on the back surface of the gear cover 57, a hole portion 78 is coaxially formed with the concave portion 78. One end of the rotation shaft 530 protruding from the lower case 56 of the conveyance screw 53 is inserted into the hole portion 78. By holding the rotation shaft 530 of the conveyance screw 53 with the hole portion 78, the gear cover 57 is positioned relative to the lower case 56.

As illustrated in FIG. 11, at an inner surface of the apparatus body 100, the protrusion 101 and the guide slit 103 are provided for each mount portion 106. The guide slit 103 vertically extends and has an opening at an upper end thereof. When the toner cartridge 50 is installed, the convex portion 79 of the toner cartridge 50 is inserted from the opening to the guide slit 103. A receiving portion is formed at a lower end of the guide slit 103 to receive the convex portion 79.

The body-side driving gear 105 is disposed at a position of the separator (see FIG. 1) near the lower end of each guide slit 103. The body-side driving gear 105 is rotated by a driving source disposed at the apparatus body 100. With the toner cartridge 50 mounted on the apparatus body 100, the body-side driving gear 105 is engaged with the conveyance driving gear 62 (see FIG. 5).

On the inner surface of the apparatus body 100, an urging member 107 is formed of, e.g., a leaf spring to urge the toner cartridge 50 and is disposed corresponding to each mount portion 106. The urging member 107 presses the toner cartridge 50 toward the gear cover 57 to cause a leading end of the convex portion 79 to contact a slit bottom of the guide slit 103. As a result, movement of the toner cartridge 50 in a longitudinal direction thereof (a vertical direction of FIG. 11) is restricted, thus preventing dropping of the convex portion 79 from the guide slit 103 and dropping of the protrusion 101 from the container-side positioning portion 73*b*.

Figure 12A:
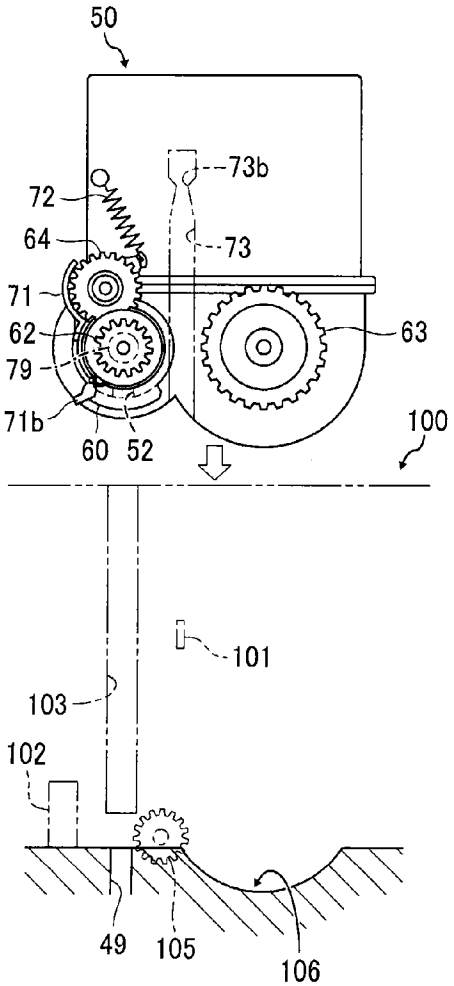
FIGS. 12A to 12C are side views of installation and removal of the toner cartridge relative to the apparatus body.

Next, installation and removal of the toner cartridge 50 relative to the apparatus body 100 in the above-described exemplary embodiment are described with reference to FIGS. 12A to 12C. When the toner cartridge 50 is installed to the apparatus body 100, a user opens the upper cover 109 of the apparatus body 100. Then, the user installs the toner cartridge 50 into the apparatus body 100 via an upper opening 111 of the apparatus body 100.

Figure 12B:
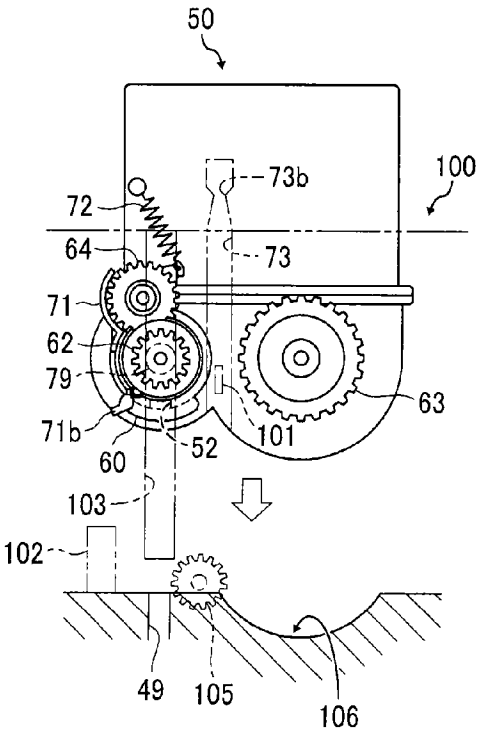

As the toner cartridge 50 is installed, as illustrated in FIG. 12B, the concave portion 79 of the toner cartridge 50 is inserted into the upper end of the guide slit 103. Since the insert direction of the toner cartridge 50 is guided along the guide slit 103 during installation, the toner cartridge 50 can be smoothly guided to the mount portion 106 without being forcefully thrust into.

Figure 12C:
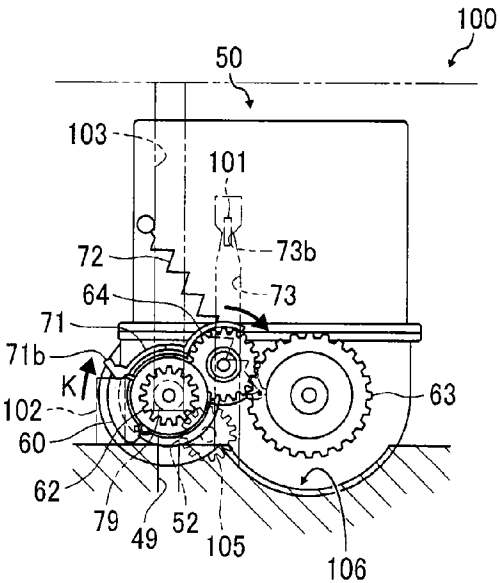

As illustrated in FIG. 12C, when the toner cartridge 50 is mounted on the mount portion 106, the concave portion 79 of the toner cartridge 50 contacts the lower end (receiving portion) of the guide slit 103 and is positioned.

With installation of the toner cartridge 50, the protrusion 101 is inserted into the slit 73 As illustrated in FIG. 12C, when the toner cartridge 50 is mounted on the mount portion 106, the protrusion 101 is placed at the container-side positioning portion 73*b* which is relatively narrow in the slit 73.

During installation, the shutter regulation member 102 of the apparatus body 100 contacts the operation part 71*b* of the gear holder 71. As a result, against the tension (urging force) of the tension spring 72, the gear holder 71 is rotated in a direction indicated by an arrow K in FIG. 12C and the torque transmission gear 64 is placed at the operating position at which the torque transmission gear 64 engages the agitation driving gear 63. With rotation of the gear holder 71, the outer shutter 60 integrally provided with the gear holder 71 is also rotated and, as a result, the outer circumferential side of the outlet 52 is opened. However, in such a state (in which the toner cartridge 50 is mounted on the apparatus body 100), the inner shutter 22 is still closed. During a series of operations to open the outer shutter 60, the outlet 52 of the toner cartridge 50 may be instantly disconnected to the replenishment port 49 of the apparatus body 100. In such a moment, toner may drop downward from the outlet 52. However, as described above, the inner shutter 22 is still closed, thus preventing toner leakage.

During movement of the torque transmission gear 64 toward the operating position, when the torque transmission gear 64 approaches the slit 73, the protrusion 101 already passes an area on the slit 73 in which the protrusion 101 might overlap the operating position, thus preventing conflict of the torque transmission gear 64 with the protrusion 101.

When the torque transmission gear 64 is moved to the operating position and engages the agitation driving gear 63, the conveyance screw 53 and the agitator 54 in the toner cartridge 50 are linked with each other so as to operate interconnectedly. Simultaneously, the outer shutter 60 integrally provided with the gear holder 71 is rotated from a position shown in FIG. 12B to a position shown in FIG. 12C. As a result, the outlet 52 is opened. The outlet 52 opened is connected to the replenishment port 49 of the apparatus body 100.

Then, the inner shutter 22 is opened. Specifically, when the upper cover 109 is closed, the inner shutter 22 is opened in conjunction with closing of the upper cover 109 via a shutter opening-and-closing assembly 200. As a result, both the inner shutter 22 and the outer shutter 60 are open, thus allowing toner to be discharged from the outlet 52.

As illustrated in FIG. 12C, in a state in which the toner cartridge 50 is mounted on the mount portion 106, the conveyance driving gear 62 engages the body-side driving gear 105. In this state, when the body-side driving gear 105 is rotated by the driving source, the driving force of the body-side driving gear 105 is transmitted to the conveyance screw 53 and the agitator 54 via the conveyance driving gear 62, the agitation driving gear 63, and the torque transmission gear 64. As a result, the conveyance screw 53 and the agitator 54 are rotated. Thus, toner is replenished from the outlet 52 opened to the developing device 4 via the replenishment port 49.

Next, when the toner cartridge 50 is removed from the apparatus body 100, the upper cover 109 is opened (see FIG. 1). In conjunction with opening of the upper cover 109, the inner shutter 22 is closed by the shutter opening-and-closing assembly 200. Then, a user removes the toner cartridge 50 from the apparatus body 100.

As illustrated in FIG. 12B, when the toner cartridge 50 is pulled up, the shutter regulation member 102 of the apparatus body 100 detaches from the operation part 71*b* of the gear holder 71. As a result, the gear holder 71 is rotated by the tension (urging force) of the tension spring 72 to return to an original position. With the rotation of the gear holder 71, the torque transmission gear 64 is placed at the retracted position at which the torque transmission gear 64 is detached from the agitation driving gear 63. It is to be noted that, at this time, the protrusion 101 passes the area on the slit 73 in which the protrusion 101 might overlap the operating position. However, when the protrusion 101 arrives at the area, the torque transmission gear 64 is already retracted from a position on the slit 73, thus preventing conflict of the protrusion 101 with the torque transmission gear 64.

As illustrated in FIG. 12B, when the gear holder 71 is rotated to the original position, the outer shutter 60 is rotated in conjunction with the rotation of the gear holder 71 to close the outlet 52. Thus, the outer shutter 60 shields the inner shutter 22 having a surface which is likely to be smudged when connected to the replenishment port 49. As a result, even if a user touches a shutter part by hand, the hand is unlikely to be smudged. Additionally, as described above, both the inner shutter 22 and the outer shutter 60 are closed, thus significantly enhancing prevention of toner scattering from the outlet 52.

As described above, when the toner cartridge 50 is installed, the outer shutter 60 is opened in conjunction with the installation of the toner cartridge 50. At this time, the upper cover 109 is still in open state, the inner shutter 22 remains closed. Such a configuration prevents toner within the toner cartridge 50 from being scattered before the outlet 52 is connected to the replenishment port 49. Then, by closing the upper cover 109, the inner shutter 22 is opened, thus allowing toner to be supplied to the developing device 4 via the outlet 52. It is to be noted that, by opening the outer shutter 60 before the installation of the toner cartridge 50 is completed, conflict of the outer shutter 60 with the replenishment port 49 can be prevented in the installation.

Additionally, when the toner cartridge 50 is removed, the inner shutter 22 is closed by opening the upper cover 109, and then the outer shutter 60 is closed in conjunction with the removal of the toner cartridge 50. Accordingly, even if toner is attached to an inner side of the outlet 52, scattering of the toner is prevented. As described above, the double shutter structure having the inner shutter 22 and the outer shutter 60 reliably prevents toner from being scattered from the outlet 52 in installation and removal of the toner cartridge 50.

Next, a configuration of the shutter opening-and-closing assembly 200 in an exemplary embodiment of this disclosure is described with reference to FIGS. 13 to 17B.

Figure 13:
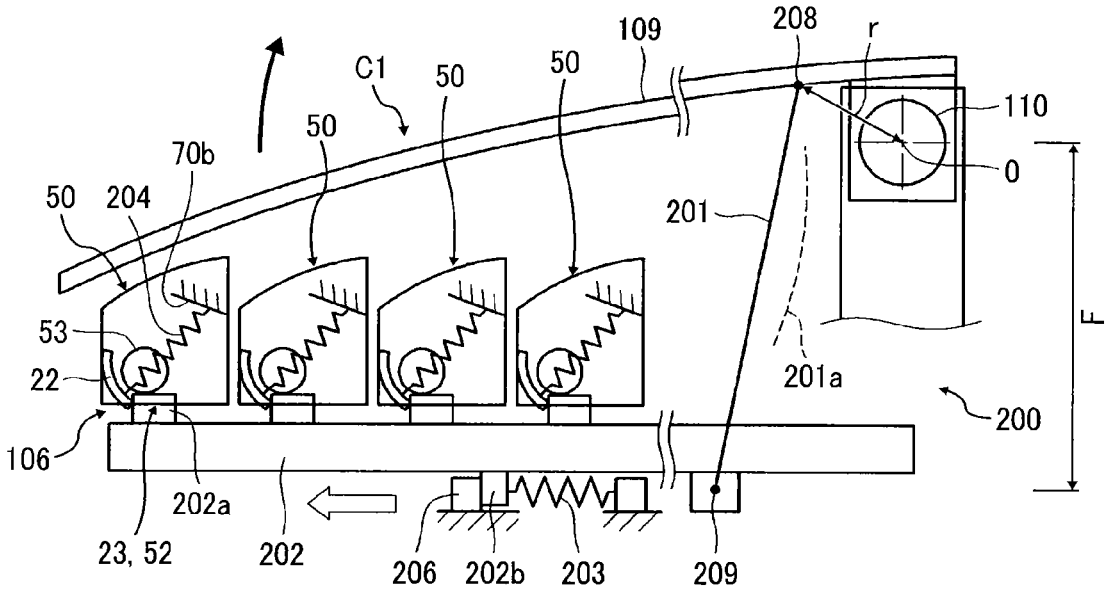
FIG. 13 is a cross-sectional view of a schematic configuration of a shutter opening-and-closing assembly in a state in which an upper cover is closed.
Figure 14:
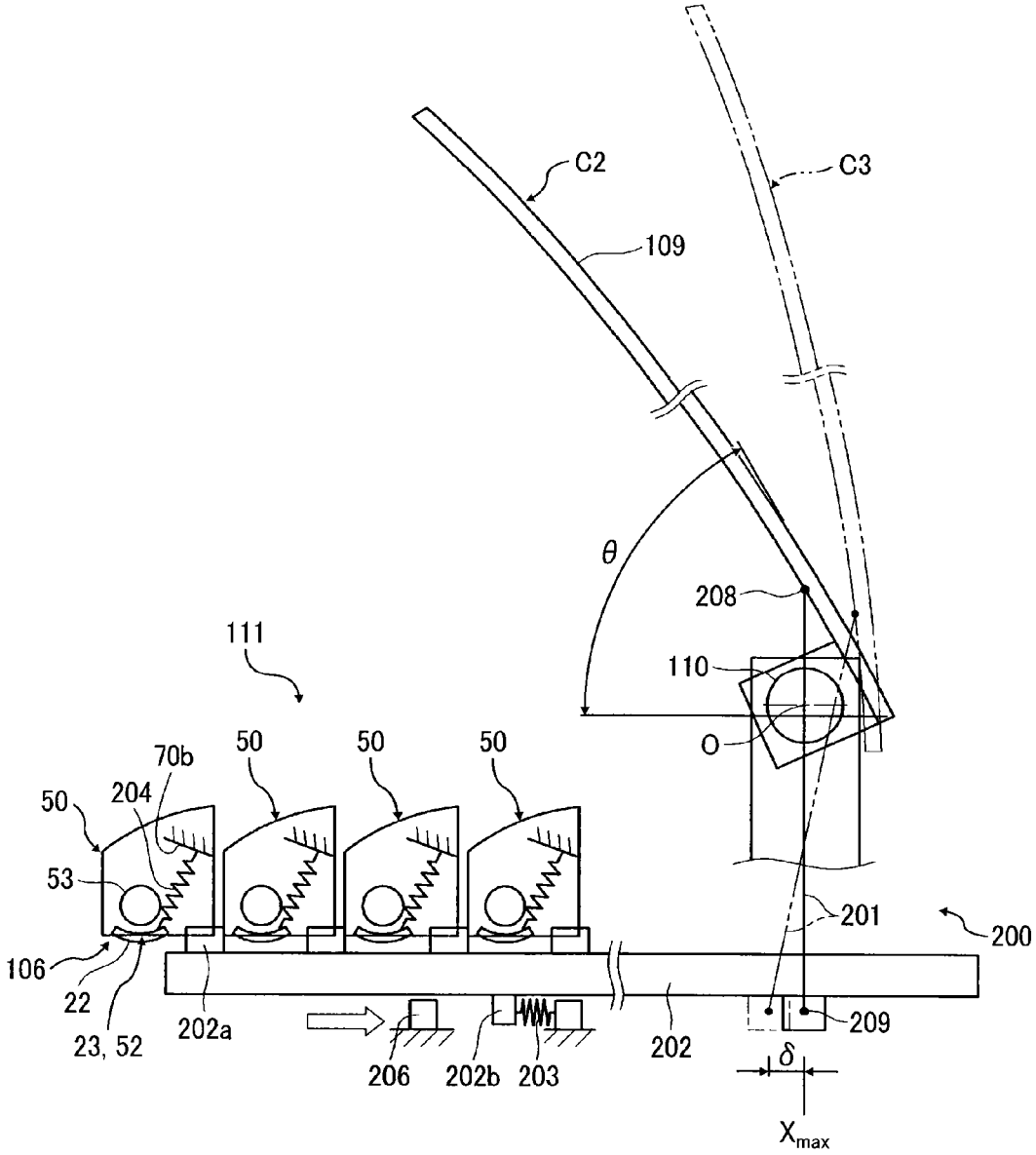
FIG. 14 is a cross-sectional view of a schematic configuration of the shutter opening-and-closing assembly in a state in which the upper cover is open.
Figure 15A:
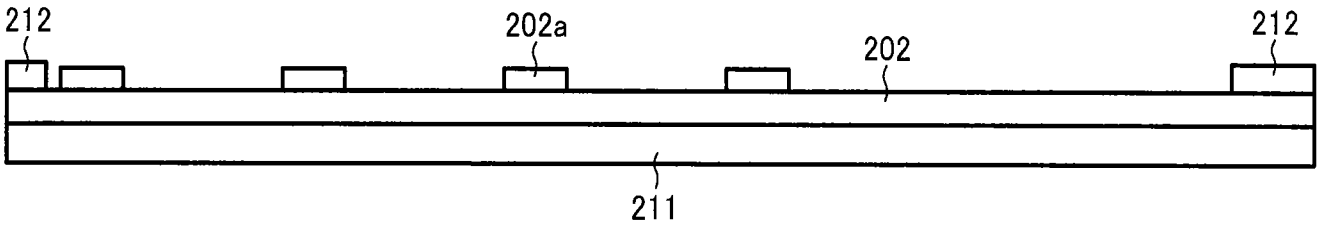
FIG. 15A is a plan view of a movable member and a guide in an exemplary embodiment of this disclosure.
Figure 15B:
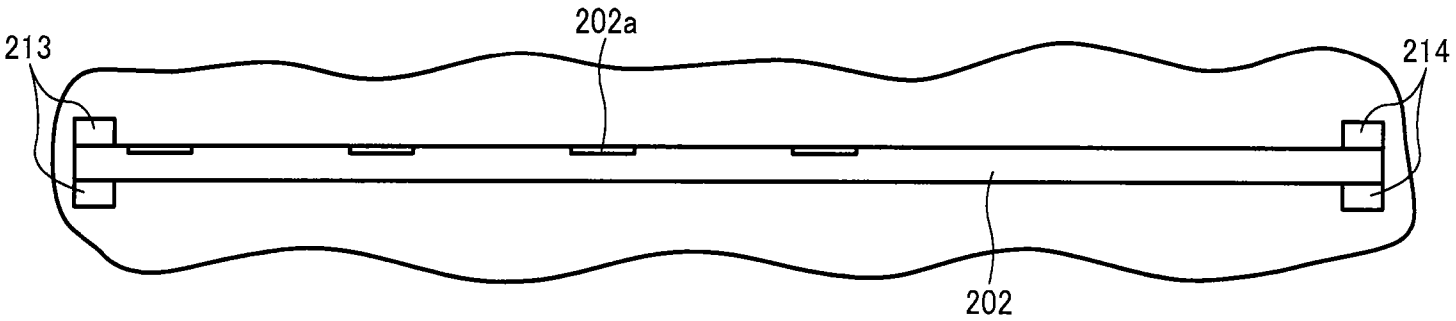
FIG. 15B is a side view of the movable member and the guide.
Figure 16:
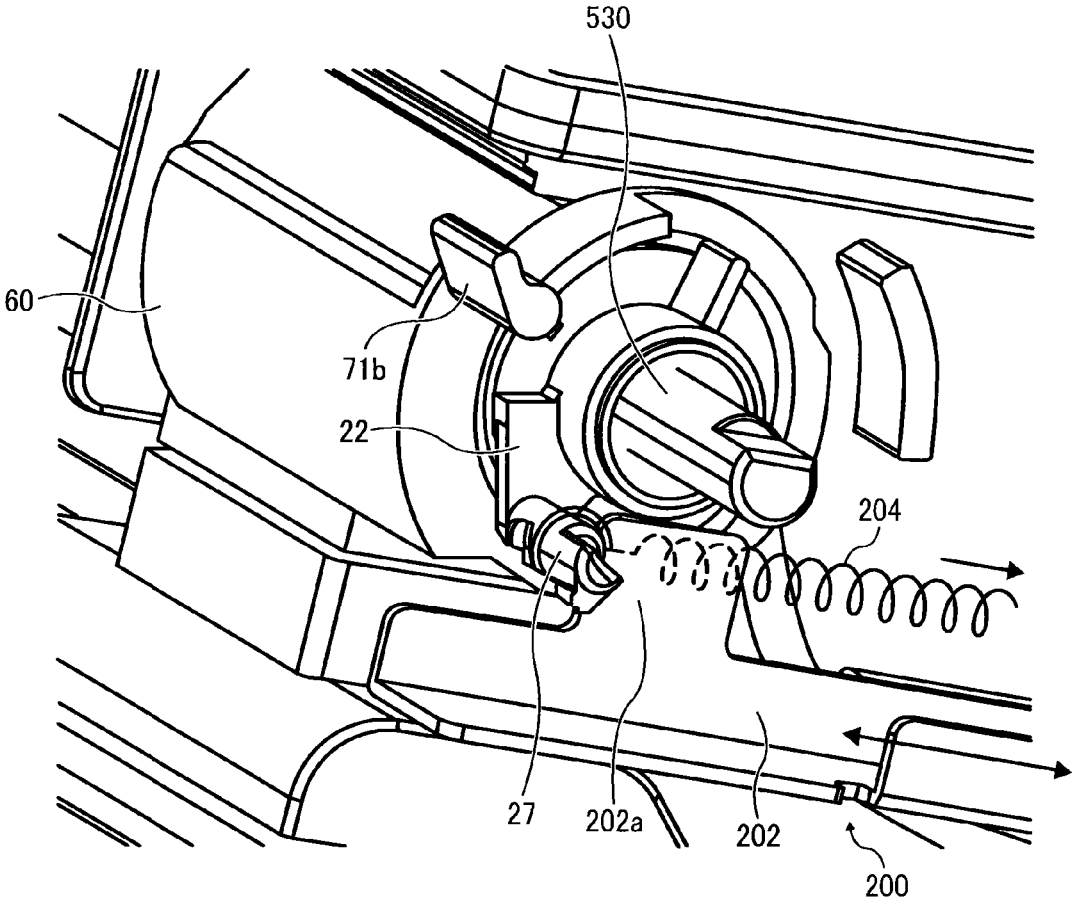
FIG. 16 is a perspective view of an inner shutter and a surrounding structure of the inner shutter.
Figure 17A:
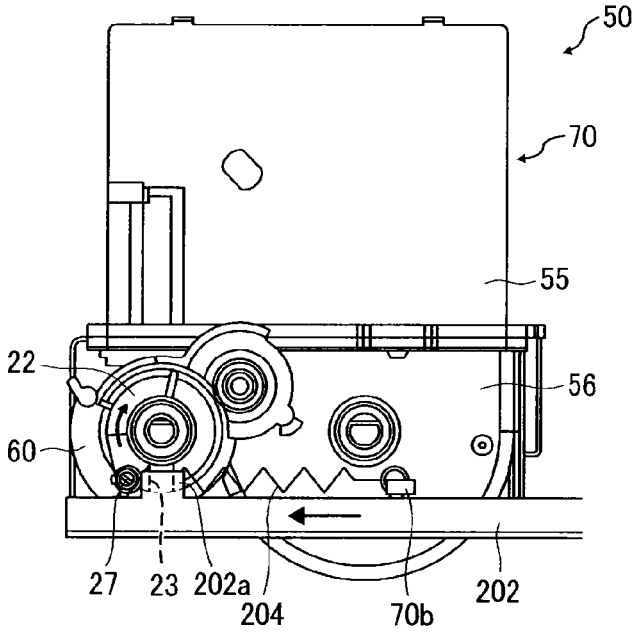
FIG. 17A is a side view of the toner cartridge in a state in which the inner shutter is open.
Figure 17B:
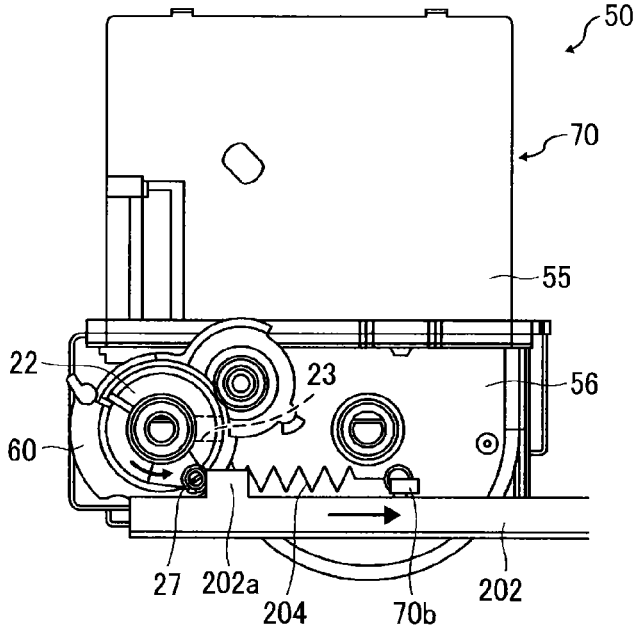
FIG. 17B is a side view of the toner cartridge in a state in which the inner shutter is closed.

FIGS. 13 and 14 are side views of a schematic configuration of the shutter opening-and-closing assembly 200 in an exemplary embodiment of this disclosure. FIGS. 15A and 15B are schematic views of a movable member of the shutter opening-and-closing assembly 200. FIG. 15A is a side view of the movable member. FIG. 15B is a plan view of the movable member. FIG. 16 is a perspective view of a portion of the shutter opening-and-closing assembly 200. FIGS. 17A and 17B are side views of a portion of the shutter opening-and-closing assembly 200. In FIG. 17A, the inner shutter 22 is open. In FIG. 17B, the inner shutter 22 is closed. It is to be noted that, as illustrated in FIG. 1, the exposing device 6 is mounted to the upper cover 109.

For the shutter opening-and-closing assembly 200, the inner shutter 22 is opened and closed in conjunction with opening and closing, respectively, of the upper cover 109 serving as a cover member shown in FIG. 1. As illustrated in FIG. 13, the shutter opening-and-closing assembly 200 includes, for example, a transmission member 201, a movable member 202, a first spring 203 serving as a first urging member, and a second spring 204 serving as a second urging member.

Around a center axis of the opening-and-closing shaft 110 serving as a rotational center O, the upper cover 109 is openable and closable between a closed position C1 illustrated in FIG. 13 and a maximum open position C3 indicated by a broken line in FIG. 14. As illustrated in FIG. 1, the rotational center O is placed at a position in an upper part of the apparatus body 100 and farthest from the conveyance path R of a sheet. When the upper cover 109 is placed at the closed position C1, the upper cover 109 is locked relative to the apparatus body 100 by a lock mechanism. Opening of the upper cover 109 is performed after the lock mechanism is unlocked. When the upper cover 109 is placed at the maximum open position C3, the upper cover 109 is also locked relative to the apparatus body 100 by a lock mechanism. In a state in which the upper cover 109 is opened to the maximum open position C3, a user can install and remove the toner cartridge 50 relative to the apparatus body 100 via the upper opening 111 of the apparatus body 100. When the upper cover 109 is closed from the maximum open position C3, an external force greater than a locking force of the lock mechanism is applied to the upper cover 109 to release the locking of the upper cover 109.

The transmission member 201 is disposed between the upper cover 109 and the movable member 202. The transmission member 201 includes a long flexible member, e.g., a metal wire. It is to be note that the material of the transmission member 201 is not limited to metal but may be, e.g., resin or any other suitable material. In addition, as the transmission member 201, not only a single wire but double wires or twisted wire can be used. The transmission member 201 is not limited to wire but may be, e.g., belt or any other suitable shape.

The transmission member 201 has one end connected to the upper cover 109 and the other end connected to the movable member 202. It is to be note that the connection of the transmission member 201 to the upper cover 109 and the movable member 202 is not limited to a particular way but may be, for example, welding or swage. Such a configuration prevents connecting portions of the transmission member 201 with the upper cover 109 and the movable member 202 from separating in operation. In some embodiments, the transmission member 201 is mounted so as to be rotatable (around a shaft extending in a vertical direction with respect to a surface of a sheet on which FIG. 13 is printed) relative to the upper cover 109 and/or the movable member 202.

As illustrated in FIG. 13, a first connecting point 208 at which the transmission member 201 is connected to the upper cover 109 is disposed at a position closer to the rotational center than a second connecting point 209 at which the transmission member 201 is connected to the movable member 202. For such a configuration, when the upper cover 109 is opened to act a pulling force from the upper cover 109 onto the transmission member 201, the movable member 202 is slid toward the rotational center O by a horizontal component of the pulling force. In a state in which the upper cover 109 is placed at the closed position C1, as indicated by a broken line, the transmission member 201 preferably has a slack 201*a* serving as play.

On a surface of the transmission member 201 may be coated with, e.g., low-friction coating as necessary. Even if the surface of the transmission member 201 is coated, such coating does not affect the positions of the transmission member 201 and the movable member 202, and accordingly the operability of the shutter opening-and-closing assembly 200 is not affected.

The movable member 202 is a long rigid body made of, e.g., metal. As illustrated in FIG. 15A, a lower surface of the movable member 202 is guided by a lower guide 211 across a whole length thereof, and an upper surface of the movable member 202 is guided by a plurality of upper guides 212 (e.g., two in FIG. 15A) that are disposed away from each other in a longitudinal direction of the movable member 202. As illustrated in FIG. 15B, both lateral faces of the movable member 202 are guided by a plurality of pairs (two pairs in FIG. 15A) of lateral guides 213 and 214 that are disposed away from each other in a longitudinal direction of the movable member 202. By guiding the movable member 202 with the lower guide 211, the plurality of upper guides 212, and the plurality of pairs of lateral guides 213 and 214, the movable member 202 is reciprocally slidable along a horizontal direction (crosswise direction on a surface of a sheet on which FIG. 13 is printed) relative to the apparatus body 100. As illustrated in FIG. 13, an extension line of a moving trajectory of the second connecting point 209 obtained when the movable member 202 is slid in the horizontal direction is offset from the rotational center O by an offset amount F in the vertical direction.

The movable member 202 has protruding portions 202*a* protruding upward. The number of the protruding portions 202*a* is the same as the number of the toner cartridges 50 mounted on the apparatus body 100 (in FIG. 13, four). The movable member 202 further has a spring mount portion 202*b*. The first spring 203 is disposed in a compressed state between the spring mount portion 202*b* and the apparatus body 100. By an urging force of the first spring 203, the movable member 202 is constantly pressed in a horizontal direction away from the rotational center O. In descriptions below, the term "forward direction" represents a direction opposite a direction in which the movable member 202 is urged by the first spring 203, and the term "reverse direction" represents the direction in which the movable member 202 is urged by the first spring 203.

To define a maximum displacement of the movable member 202 in the reverse direction, the apparatus body 100 has a first stopper 206 to engage the movable member 202. In FIGS. 13 and 14, a configuration is shown in which the first stopper 206 is engaged with the spring mount portion 202*b*.

As illustrated in FIG. 16 and FIGS. 17A and 17B, the inner shutter 22 has a projection 27 serving as a contact portion. The projection 27 is disposed at an end portion of the inner shutter 22 exposed from the lower case 56 and projects in an axial direction of the inner shutter 22. A second spring 204 is mounted in stretched state between the projection 27 and an attachment portion 70*b* disposed at a side face of the lower case 56. By urging force of the second spring 204, the inner shutter 22 is constantly urged in a direction to close the inner shutter 22. A total urging force of the second spring 204 of the toner cartridge 50 is smaller than the urging force of the first spring 203.

Next, an operation of the shutter opening-and-closing assembly 200 in an exemplary embodiment of this disclosure is described below. As illustrated in FIG. 13, in a state in which the upper cover 109 is placed at the closed position C1, the movable member 202 is urged in the reverse direction (toward the left side in FIG. 13) by urging force of the first spring 203. Accordingly, the protruding portion 202*a* of the movable member 202 contacts the projection 27, and the inner shutter 22 is held in open state against the urging force of the second spring 204. As a result, the outlet 52 is turned into open state as illustrated in FIG. 9A.

When the upper cover 109 is opened from the closed position C1, the first connecting point 208 connecting the transmission member 201 to the upper cover 109 draws an arc-shaped trajectory having as a rotation radius "r" a distance between the first connecting point 208 and the rotational center O. In an initial period of the opening operation, the slack 201*a* of the transmission member 201 is lost and the transmission member 201 is tensed. Until the transmission member 201 comes into tension as described above, even if the upper cover 109 is opened, the movable member 202 is not moved. As a result, the closed state of the inner shutter 22 is maintained. As described above, when the upper cover 109 is at the closed position C1, the transmission member 201 has the slack 201*a* as a play. Such a configuration cancels manufacturing errors of components of the shutter opening-and-closing assembly 200, thus allowing stable operation of the shutter opening-and-closing assembly 200 in large-scale production.

When the upper cover 109 is further opened after the transmission member 201 comes into tension, the opening operation of the upper cover 109 is transmitted to the movable member 202 via the transmission member 201. As a result, the movable member 202 is slid in the forward direction (toward the right side in FIG. 13) by a horizontal component of a pulling force acting on the transmission member 201. When the transmission member 201 is tensed, the transmission member 201 serves as a rigid body. In such a state, the shutter opening-and-closing assembly 200 includes three pairs of rotors and one pair of sliders and constitutes a reciprocally slider crank assembly in which the upper cover 109 serves as a driver. As described above, employing such a reciprocal slider crank assembly as the shutter opening-and-closing assembly 200 facilitates reverse of the movement direction of the movable member 202 in a terminal period of the opening operation of the upper cover 109.

With the sliding of the movable member 202 in the forward direction, the first spring 203 is compressed to accumulate more urging force. By the sliding of the movable member 202 in the forward direction, the pressing force of the protruding portions 202*a* against the projection 27 is lost. Thus, the inner shutter 22 is rotated counterclockwise in FIG. 13 by the urging force of the second spring 204. As a result, the developer outlet 23 is turned to the right side as illustrated in FIG. 17B, and the outlet 52 is closed as illustrated in FIG. 9B.

When the upper cover 109 is opened to an intermediate position C2 indicated by a solid line in FIG. 14 after the outlet 52 is closed with the inner shutter 22, the movable member 202 arrives at a maximum displacement Xmax in the forward direction. Then, until the upper cover 109 is opened to the maximum open position C3 indicated by a broken line in FIG. 14, the opening operation of the upper cover 109 is not transmitted to the movable member 202 because of flexibility of the transmission member 201. At this time, the movable member 202 is slid in the reverse direction by the urging force accumulated in the first spring 203. As described above, while the upper cover 109 is moved from the intermediate position C2 to the maximum open position C3, the movement direction of the movable member 202 is reversed from the forward direction to the reverse direction, and the movable member 202 is slide in the reverse direction by a distance δ.

While the movable member 202 is reversed and moved in the reverse direction, the closed state of the inner shutter 22 is maintained. To maintain the closed state of the inner shutter 22, when the upper cover 109 is placed at the maximum open position C3, a clearance is formed to have a proper width (preferably a width of the distance δ or greater) between the protruding portions 202*a* and the projection 27 so that, during such reverse movement, the protruding portions 202*a* of the movable member 202 does not contact the projection 27 to open the inner shutter 22.

Figure 18:
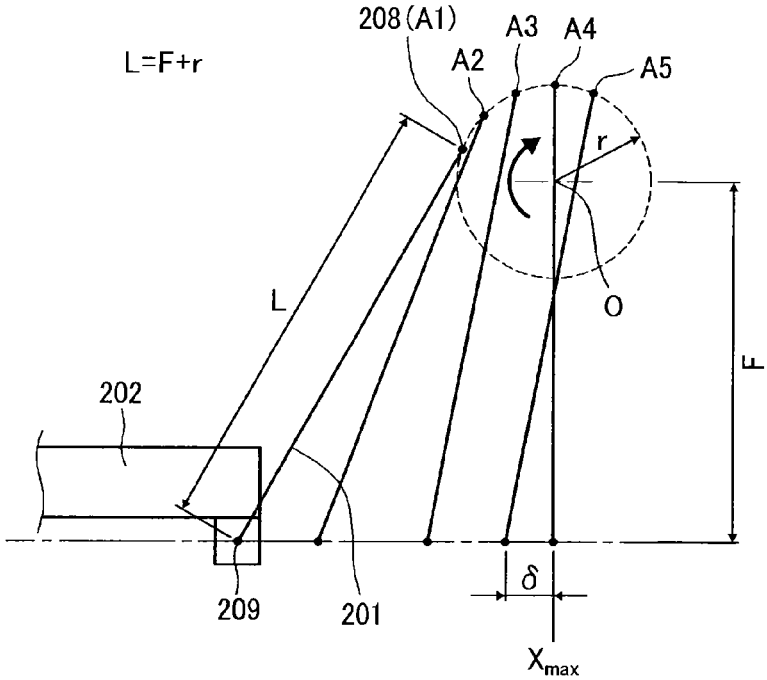
FIG. 18 is a side view of a postural change of a transmission member during opening of an upper cover in an exemplary embodiment of this disclosure.

FIG. 18 is a schematic view of the transmission member 201 during the above-described opening operation of the upper cover 109 and after the transmission member 201 comes into tension. In FIG. 18, the length L of the transmission member 201 is set to be equal to a sum of the offset amount F of the rotational center O and the rotation radius r of the first connecting point 208 (L=F+r).

When the upper cover 109 is opened, the first connecting point 208 is moved from a point A1 to points A2, A3, A4, and A5 in turn. While the first connecting point 208 is moved from the point A1 to the point A4, the transmission member 201 in tensed state is gradually raised to an upright position. When the first connecting point 208 reaches an upmost position on the rotation trajectory (the point A4), the transmission member 201 is directed in the vertical direction so as to pass the rotational center O. At this time, the movable member 202 reaches the maximum displacement Xmax in the forward direction. Then, when the upper cover 109 is further opened, the movable member 202 is slid by the urging source of the first spring 203 in the reverse direction by the distance δ while the first connecting point 208 is moved from the point A4 to the point A5. Thus, the transmission member 201 is returned to a tilted posture again.

Figure 19:
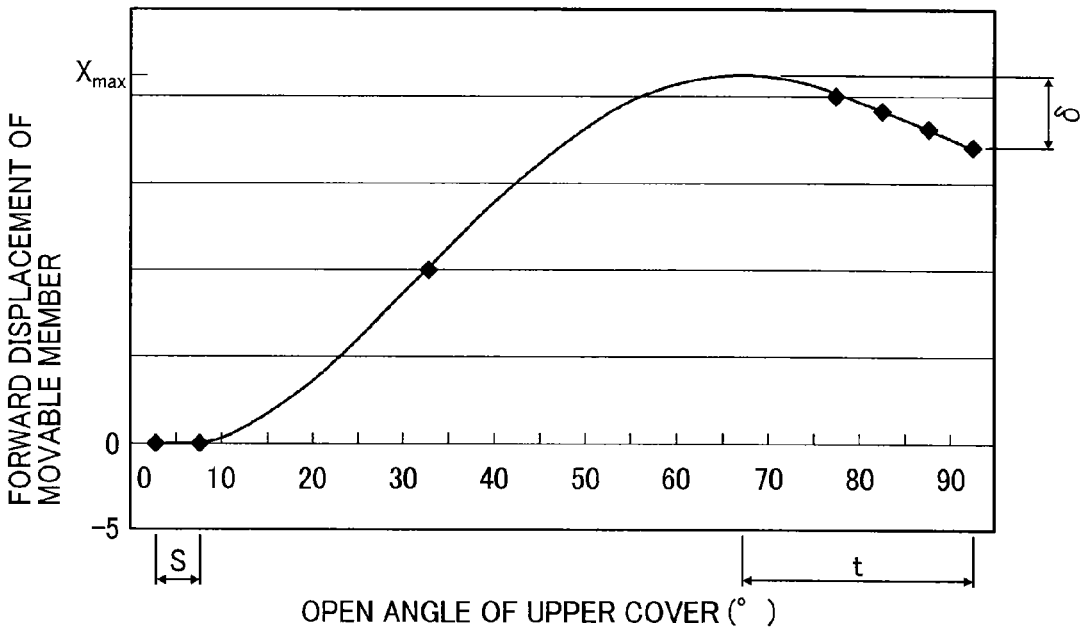
FIG. 19 is a graph of a relation between open angle of the upper cover and displacement of the movable member in a forward direction.

FIG. 19 is a graph of a relation between the open angle θ (see FIG. 14) of the upper cover 109 and the displacement amount of the movable member 202 in the forward direction in the shutter opening-and-closing assembly 200. As illustrated in FIG. 19, until the transmission member 201 having the slack 201 a comes into tension, for example, in a period s in which the open angle of the upper cover 109 changes from 0 degree to 10 degrees, the movable member 202 remains stopped. Then, as the open angle θ increases, the movable member 202 is slid in the forward direction. When the open angle θ reaches, for example, approximately 70 degrees, the movable member 202 reaches the maximum displacement Xmax. Then, in a period t in which the open angle θ reaches to 90 degrees, the movable member 202 is slide in the reverse direction by the distance δ.

Next, an operation of the shutter opening-and-closing assembly 200 performed when the shutter opening-and-closing assembly 200 is closed from the maximum open position C3 shown in FIG. 14 is described below. In a state in which the upper cover 109 is at the maximum open position C3, as described above, the upper cover 109 is locked with the lock mechanism so that the position of the upper cover 109 is maintain against the urging force of the movable member 202. When the upper cover 109 is closed, for example, a user applies in a closing direction to the upper cover 109 a force greater than the binding force of the lock mechanism, thus unlocking the lock mechanism.

During closing operation of the upper cover 109, the closing operation of the upper cover 109 is not transmitted to the movable member 202 because of flexibility of the transmission member 201. The movable member 202 is slid in the reverse direction by urging force accumulated in the first spring 203. By sliding of the movable member 202 in the reverse direction, the protruding portion 202*a* of the movable member 202 contacts the projection 27, and the movable member 202 is slid in the reverse direction against the urging force of the second spring 204. As a result, the inner shutter 22 is moved to the open position. The outlet 52 is opened and the shutter opening-and-closing assembly 200 is returned to a state illustrated in FIG. 13.

As described above, during opening and closing of the upper cover 109, the shape, posture, and position of the transmission member 201 sequentially changes. In such processes, a large space enough to encompass the movement trajectory of the transmission member 201 is created in the inside of the apparatus body 100 so that the transmission member 201 does not conflict with respective devices in the apparatus body 100.

As described above, in the above-described exemplary embodiments, in a terminal period of the opening operation of the upper cover 109, the movement direction of the movable member 202 is reversed from the forward direction to the reverse direction. Such a configuration shortens a reciprocal stroke of the movable member 202 performed with opening and closing of the upper cover 109. By preventing an excess stroke of the movable member 202 as such, the degree of freedom of the layout around the movable member 202 or the inner shutter 22 is increased, thus enhancing the degree of freedom of design of the image forming apparatus. Additionally, the maximum open angle of the upper cover 109 can be set to be a relatively large value, thus enhancing the operability in installation and removal of the toner cartridge 50 relative to the apparatus body 100.

Furthermore, since the sliding movement of the movable member 202 in the reverse direction during closing of the upper cover 109 is performed by the urging force of the first spring 203 accumulated during the sliding movement of the movable member 202 in the forward direction, a user can close the upper cover 109 by small power. The transmission member 201 is also formed of, for example, a flexible wire, thus allowing the upper cover 109 to be closed by a further small power. When the above-described effects are not prioritized, the transmission member 201 may be formed of a rigid body. In such a case, the first spring 203 can be omitted.

In particular, as described above, in the configuration in which the length L of the transmission member 201 is equal to a sum of the offset amount F of the rotational center O and the rotation radius r of the first connecting point 208, as illustrated in FIG. 18, the movable member 202 can be reversed within an area from the upmost point A4 of the movement trajectory to the point A5 slightly lower than A4. In such a case, the positional relation between the initial point A1 and the end position A5 of the first connecting point 208 substantially corresponds to a positional relation between the closed position C1 and the maximum open position C3 of the upper cover 109 illustrated in FIGS. 13 and 14. Accordingly, the maximum open position C3 of the upper cover 109 can be set to be a proper position illustrated in FIG. 14 (e.g., maximum open angle of 90 degrees).

Figure 20:
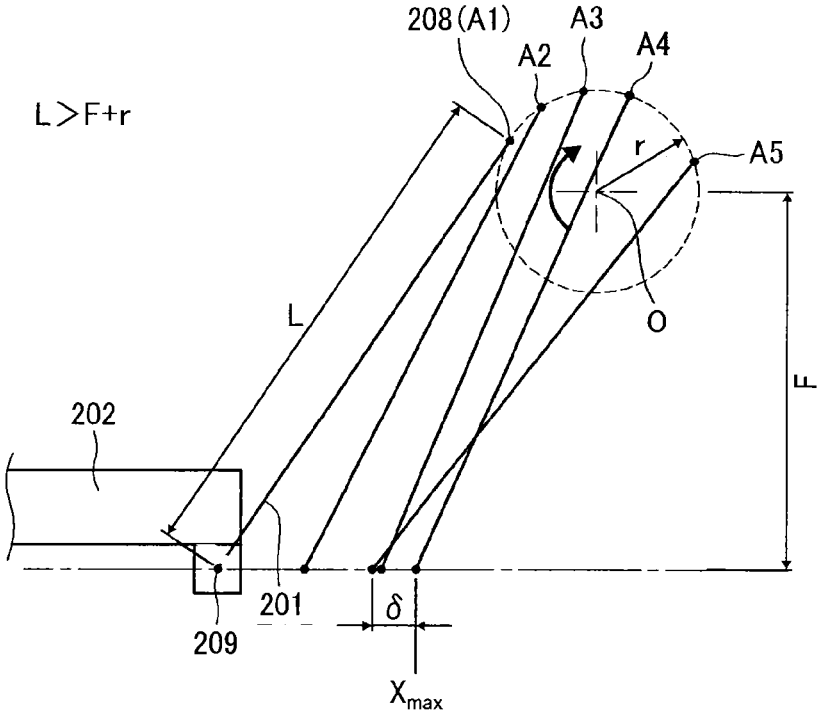
FIG. 20 is a side view of a postural change of a transmission member during opening of an upper cover in an exemplary embodiment of this disclosure.
Figure 21:
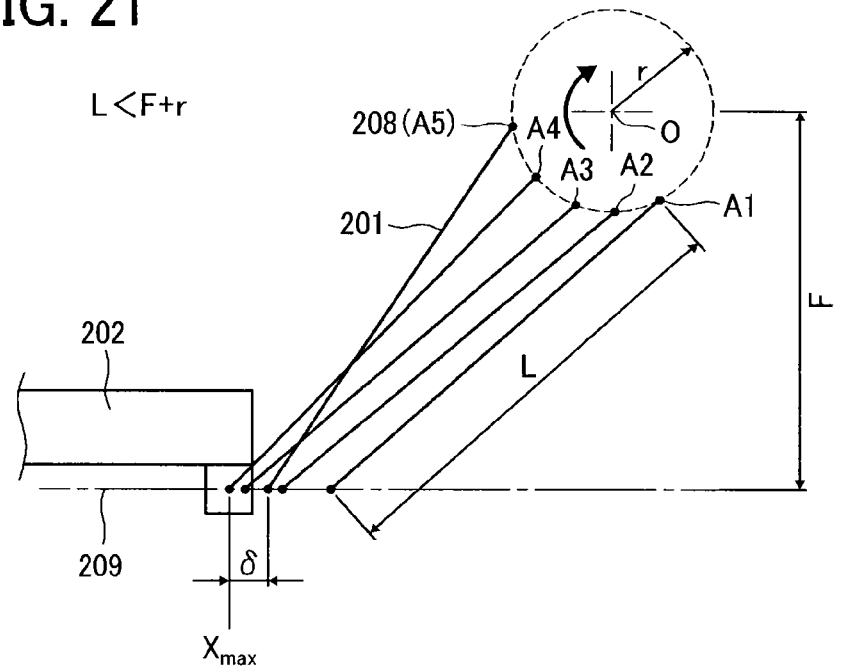
FIG. 21 is a side view of a postural change of a transmission member during opening of an upper cover in an exemplary embodiment of this disclosure.

It is to be noted that the length L of the transmission member 201 is not limited to a length equal to the sum (F+r) of the offset amount F of the rotational center O and the rotation radius r of the first connecting point 208. In some embodiments, for example, the length L of the transmission member 201 is greater or smaller than the sum (F+r). FIG. 20 is a schematic view of change in posture of a transmission member 201 in an exemplary embodiment in which L>F+r is satisfied. FIG. 21 is a schematic view of change in posture of a transmission member 201 in an exemplary embodiment in which L<F+r is satisfied.

As illustrated in FIG. 20, in the exemplary embodiment of FIG. 20, with opening of an upper cover 109, a first connecting point 208 is moved in substantially the same manner as that of the exemplary embodiment of FIG. 18. On the other hand, when a first connecting point 208 is moved to a position lower than in the exemplary embodiment of FIG. 18, movement direction of a movable member 202 is reversed. In such a case, if a maximum open position C3 of the upper cover 109 is set so as to correspond to an end point A5 of the first connecting point 208, the upper cover 109 takes a maximum open state in a posture more tilted in an open direction than the maximum open position C3 illustrated in FIG. 14. Consequently, the maximum open angle θ is relative large. Further, as illustrated in FIG. 21, in the exemplary embodiment of FIG. 21, sliding direction of a movable member 202 is reversed from sliding movement in the reverse direction to sliding movement of the forward direction, which is opposite to the exemplary embodiments of FIGS. 18 and 20. As a result, movement directions of the movable member 202 to open and close the inner shutter 22 the inner shutter 22 are opposite to those of the exemplary embodiment of FIG. 13. Consequently, the configuration of the shutter opening-and-closing assembly 200 might be complicated.

The length L of the transmission member 201, the offset amount F of the rotational center O, and the rotation radius r of the first connecting point 208 can be set to any value. However, for the above-described reasons, the length L, the offset amount F, and the rotation radius r are preferably set to satisfy L≥F+r, and more preferably L=F+r.

Figure 22:
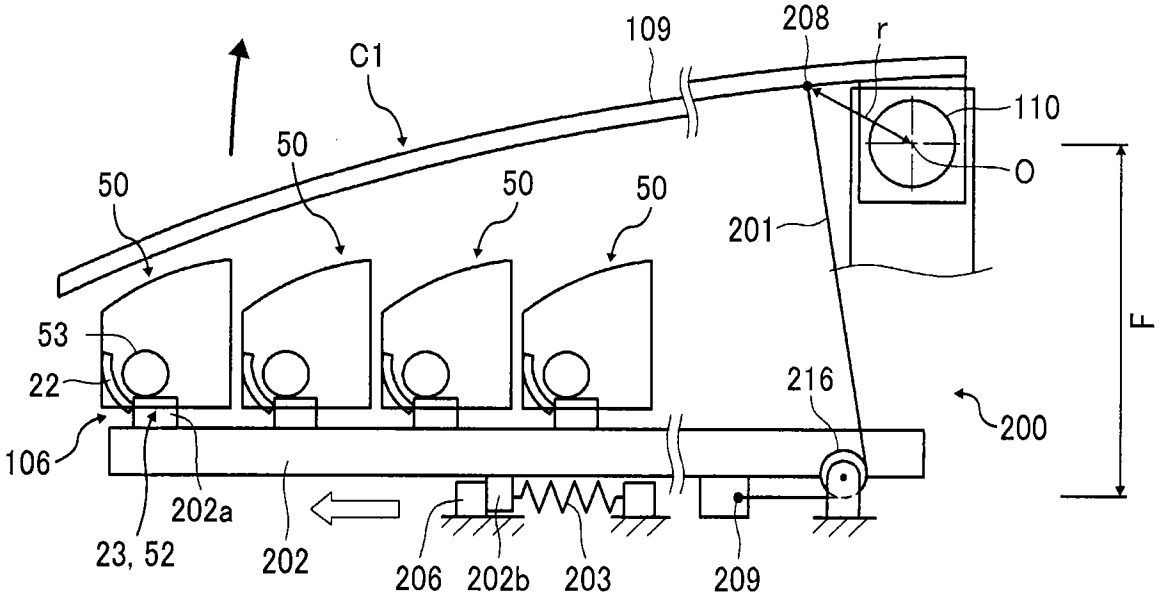
FIG. 22 is a cross-sectional view of a shutter opening-and-closing assembly in a state in which an upper cover member is closed in an exemplary embodiment of this disclosure.
Figure 23:
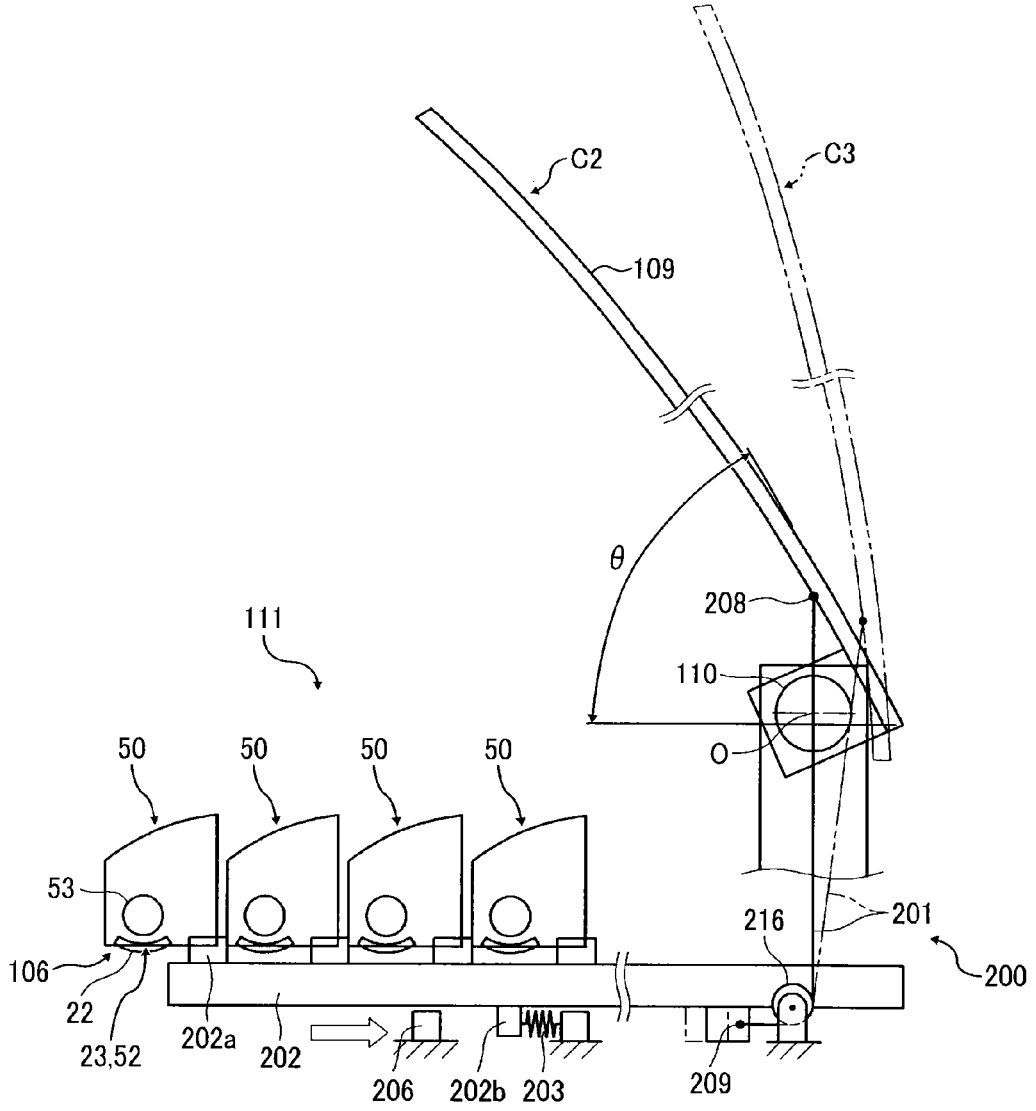
FIG. 23 is a cross-sectional view of the shutter opening-and-closing assembly in a state in which the upper cover member is open.

FIGS. 22 and 23 are views of a shutter opening-and-closing assembly 200 in another exemplary embodiment of this disclosure. The exemplary embodiment illustrated in FIGS. 22 and 23 differs from the exemplary embodiment illustrated in FIG. 13 in that a transmission member 201 is wound around a direction changer 216 including, e.g., a pulley to change an extending direction of the transmission member 201 between areas upstream and downstream from the direction changer 216. For such a configuration, the distance in a horizontal direction between a first connecting point 208 and a second connecting point 209 can be set to be smaller in a closed state of an upper cover 109, or the positional relation in the horizontal direction between the first connecting point 208 and the second connecting point 209 can be set to be opposite to the positional relation of the exemplary embodiment illustrated in FIG. 13. Thus, the degree of freedom of layout of components is further enhanced.

In FIGS. 22 and 23, a support portion of the direction changer (e.g., pulley) 216 is fixed to the apparatus body 100. In some embodiments, such a support portion of the direction changer 216 is disposed so as to be relatively movable relative to the apparatus body 100 (the pulley of the former direction changer 216 corresponds to fixed pulley, and the pulley of the latter direction changer 216 corresponds to moving pulley). For such a configuration, even under a condition in which, when the upper cover 109 is opened, excess burden acts on the pulley via the transmission member 201, such failure can be prevented, thus allowing smooth opening of the upper cover 109. Instead of the pulley, for example, a rolling bearing or sliding bearing is usable as the direction changer 216. In such a case, the transmission member 201 is wound around an outer circumferential surface of the rolling or sliding bearing.

Figure 24:
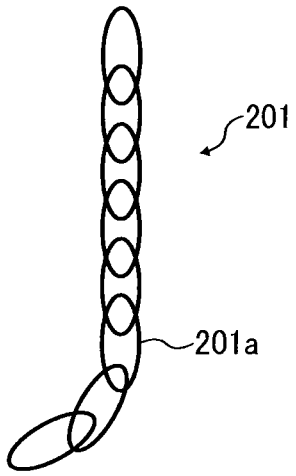
FIG. 24 is a side view of a transmission member in an exemplary embodiment of this disclosure.

FIG. 24 is a schematic view of a transmission member 201 including a plurality of segments 201*a* in an exemplary embodiment of this disclosure. For example, it is conceivable to employ a configuration in which the plurality of segments 201*a* have a ring shape and are separatably connected to each other in a chain form. For such a configuration, when the image forming apparatus is disassembled in, e.g., maintenance, both ends of the transmission member 201 are removable from the upper cover 109 or the movable member 202 and dividable at a middle position, thus enhancing the degree of freedom of disassembly.

Figure 25:
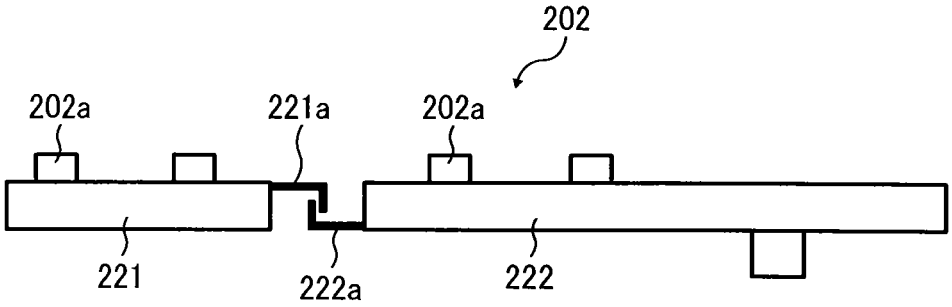
FIG. 25 is a side view of a movable member in an exemplary embodiment of this disclosure.

FIG. 25 is a schematic view of a movable member 202 according to an exemplary embodiment of this disclosure in which the movable member 202 is segmented at multiple positions in a longitudinal direction thereof. If the movable member 202 is an integrated long component, the long length may give disadvantages in processing or handling. By contrast, in this exemplary embodiment, as illustrated in FIG. 25, the movable member 202 is segmented into a plurality of segments 221 and 222. The segments 221 and 222 have, e.g., hooks 221*a* and 222*a* at respective connecting portions. Thus, the segments 221 and 222 are detachable from and connectable to each other, thus enhancing easiness of processing and operability in disassembling operation.

FIGS. 26 to 29 are schematic views of an image forming apparatus according to an exemplary embodiment of this disclosure. Different parts from those of the above-described exemplary embodiments are described below.

Figure 26:
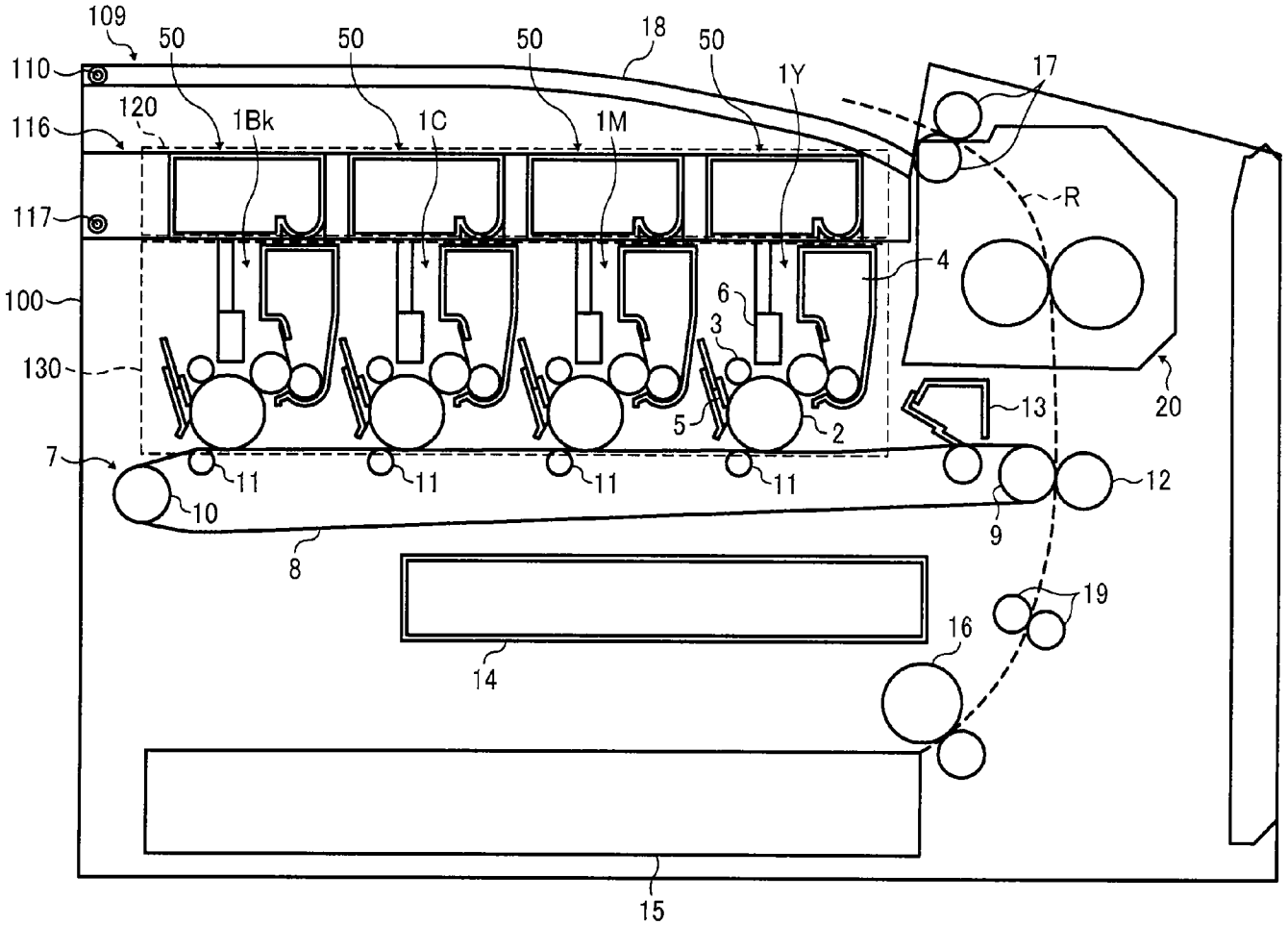
FIG. 26 is a cross-sectional view of a schematic configuration of an image forming apparatus according to an exemplary embodiment of this disclosure.
Figure 27:
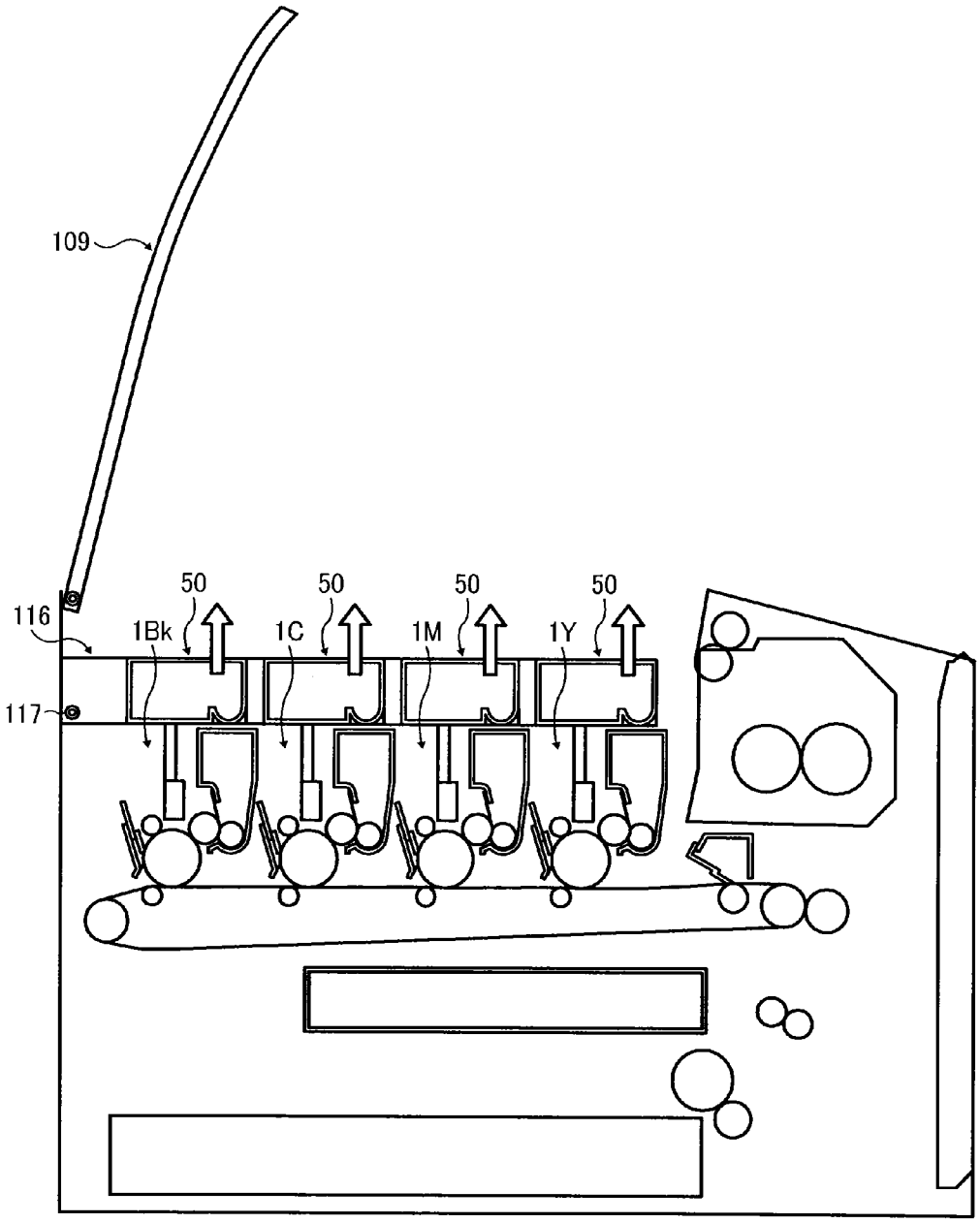
FIG. 27 is a cross-sectional view of the image forming apparatus of FIG. 26 in a state in which an upper cover is open.
Figure 28:
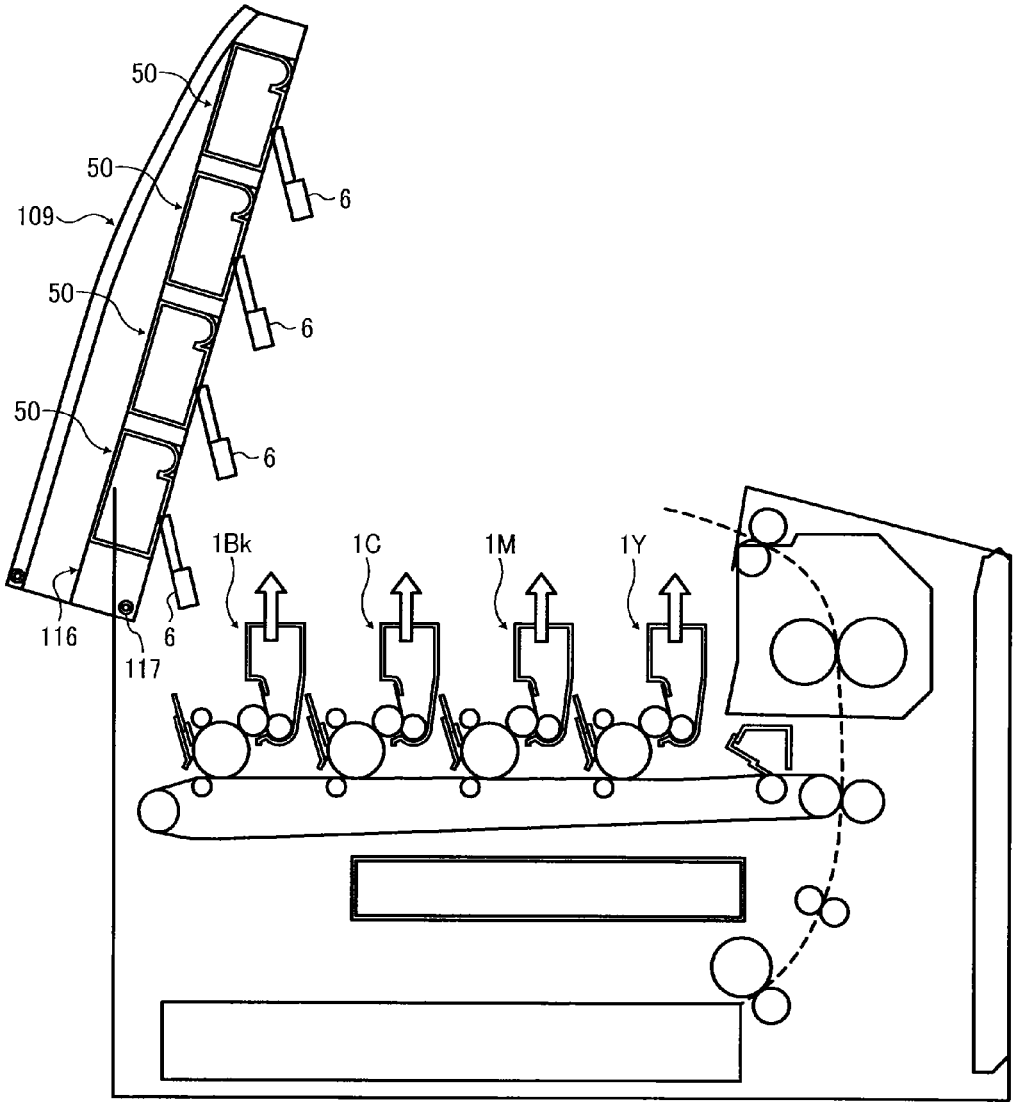
FIG. 28 is a cross-sectional view of the image forming apparatus of FIG. 26 in a state in which the upper cover and an inner cover are open.

As illustrated in FIG. 26, the image forming apparatus includes, e.g., an apparatus body 100, an upper cover 109, a container mount portion 120, an inner cover 116, and a unit mount portion 130. The upper cover 109 is mounted on an upper portion of an apparatus body 100. By opening the upper cover 109, a toner cartridge 50 is mountable to and removable from the container mount portion 120. The inner cover 116 is openably and closably disposed at an inner side of the apparatus body 100 than the container mount portion 120. By opening the inner cover 116, process units 1Y, 1M, 1C, and 1Bk are mountable to and removable from the unit mount portion 130. FIG. 27 is a schematic view of the image forming apparatus in a state in which the upper cover 109 is open. FIG. 28 is a schematic view of the image forming apparatus in a state in which the inner cover 116 is open.

For example, the inner cover 116 is mounted on the apparatus body 100 so as to open and close upward and downward relative to the apparatus body 100 by rotating around a supporting point 117. Toner cartridges 50 containing different colors of toner are mountable on the inner cover 116. Like the above-described exemplary embodiments, an upper surface of the inner cover 116 has a plurality of mount portions 106 to mount the toner cartridges 50. As illustrated in FIG. 27, in a state in which the upper cover 109 is open, the toner cartridges 50 is removable and mountable.

The process units 1Y, 1M, 1C, and 1Bk of respective colors of yellow, magenta, cyan, and black are accommodated within (at a lower side of) the inner cover 116. Accordingly, when the process units 1Y, 1M, 1C, and 1Bk are installed or removed, as illustrated in FIG. 28, both the upper cover 109 and the inner cover 116 are opened. In addition, on a lower surface of the inner cover 116, a plurality of exposing devices 6 (e.g., a light emitting diode (LED) unit) is swingably mounted to irradiate light beams onto the photoreceptors 2. Thus, with opening and closing operation of the inner cover 116, each of the exposing devices 6 is moved between a position adjacent to the photoreceptor 2 and a position retracted upward from the adjacent position while avoiding conflict with the process units 1Y, 1M, 1C, and 1Bk by the a guide unit.

For such a configuration, by opening the inner cover 116, the toner cartridges 50 are retracted from an area above the process units 1Y, 1M, 1C, and 1Bk with the toner cartridges 50 mounted on the inner cover 116, thus allowing the process units 1Y, 1M, 1C, and 1Bk to be mounted and removed without removal of the toner cartridges 50. Thus, easiness of handling in replacement of the process units 1Y, 1M, 1C, and 1Bk is enhanced while suppressing risk of scattering of toner from the toner cartridges 50 into the inside of the apparatus body 100. In the above-described configuration, the inner shutter 22 of each toner cartridge 50 is opened and closed in conjunction with opening and closing operation of the upper cover 109 via a shutter opening-and-closing assembly 200.

On the other hand, in a state in which the inner cover 116 is closed, the process units 1Y, 1M, 1C, and 1Bk are not visible from the outside. Consequently, when a plurality of colors of process units 1 are replaced at the same time, the upper cover 109 and the inner cover 116 might be closed with one or more of the plurality of process units 1 not mounted. In such a case, if an outlet 52 of one of the toner cartridges 50 corresponding to a demounted process unit 1 is opened, toner would be scattered inside the apparatus body 100.

Figure 29:
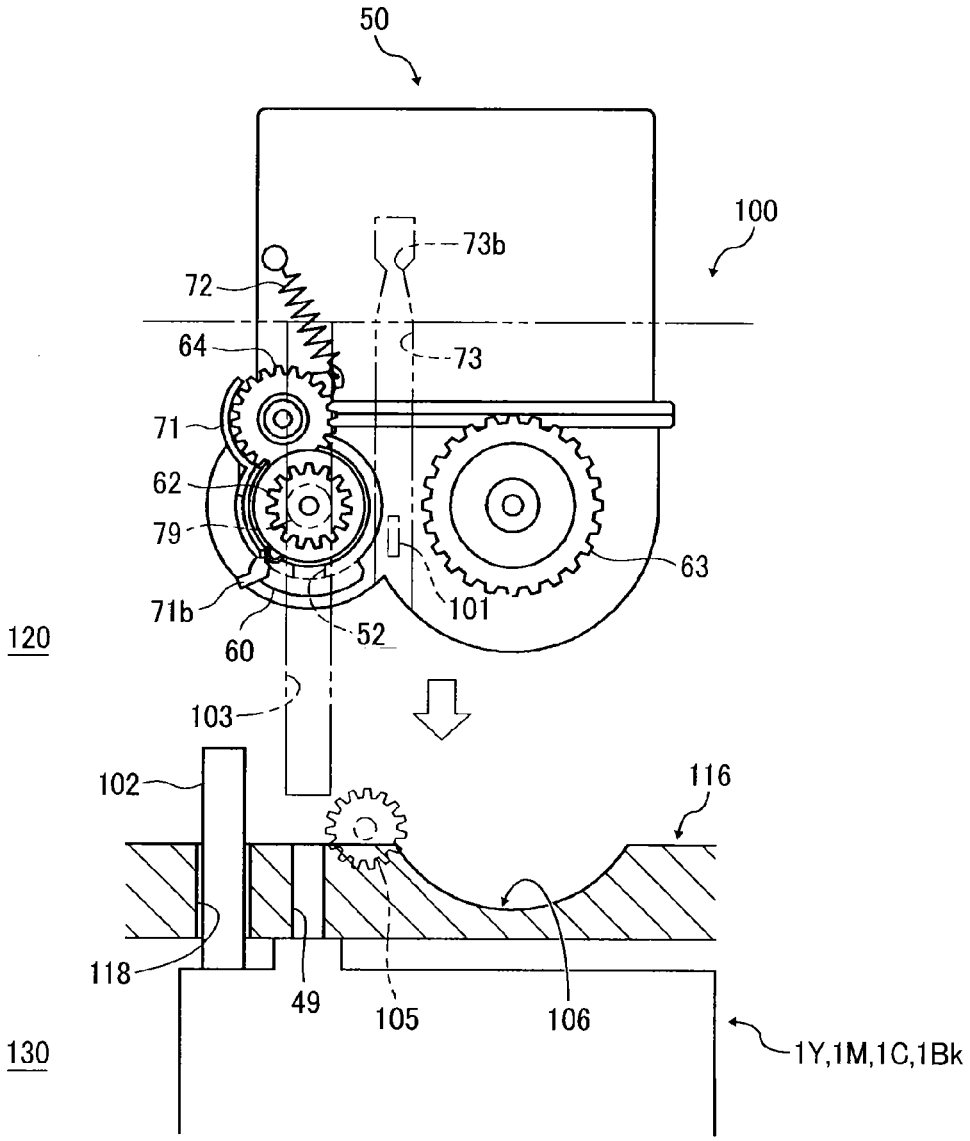
FIG. 29 is a cross-sectional view of a toner cartridge and a process unit having a contact portion in the image forming apparatus of FIG. 26.

Hence, to prevent such toner scattering, as illustrated in FIG. 29, a shutter regulation member 102 is disposed on each of the process units 1Y, 1M, 1C, and 1Bk to open an outer shutter 60. Additionally, the inner cover 116 has an insertion hole 118 through which the shutter regulation member 102 is inserted. Accordingly, when the process units 1Y, 1M, 1C, and 1Bk are mounted and the inner cover 116 is closed, the shutter regulation member 102 is inserted through the insertion hole 118 and the shutter regulation member 102 is protruded into the container mount portion 120.

For the above-described configuration, since the shutter regulation member 102 to open the outer shutter 60 is not disposed at positions at which the process units 1Y, 1M, 1C, and 1B are not mounted, the outer shutter 60 is not opened. Thus, even if the inner cover 116 is closed with the process units 1Y, 1M, 1C, and 1B not mounted, the outer shutter 60 are not opened at positions at which the process units 1Y, 1M, 1C, and 1B are not mounted, thus preventing scattering of toner.

In the above description, with reference to FIGS. 26 to 29, another exemplary embodiment of this disclosure is described. The same configuration and components/elements as those of the above-described exemplary embodiments provide the same operations and effects as those of the above-described exemplary embodiments.

The present invention is not limited to the above-described exemplary embodiments. For the number, shape, arrangement, and functions of each component, various modifications and changes can be applied within a scope of the present invention. For example, in the above-described exemplary embodiments, the configuration is described in which the outlet 52 is opened and closed by a double shutter including the inner shutter 22 and the outer shutter 60. However, the present invention is applicable to a configuration in which the outlet 52 is opened and closed by a single shutter. In such a configuration, the single shutter is opened and closed by the shutter opening-and-closing assembly 200. For example, in a configuration in which the toner cartridge 50 is integrated with, e.g., the developing device 4 and the photoreceptor 2 as a replaceable process unit, a housing (developer container) of the process unit may have a discharge port of waste toner removed from the photoreceptor 2 and the discharge port may be opened and closed with a shutter. Such a shutter can be opened and closed with the shutter opening-and-closing assembly 200.

In the above-described exemplary embodiments, the inner shutter 22 is closed by urging force of the second spring 204, and the inner shutter 22 is opened by contact of the movable member 202 against the projection 27. By contrast, the shutter opening-and-closing assembly 200 may have a configuration in which the inner shutter 22 is closed by contact of the movable member 202 against the projection 27, and the inner shutter 22 is opened by urging force of the second spring 204.

What is claimed is:

1. An image forming apparatus, comprising:

an apparatus body having an opening;

a developer container to contain developer, the developer container removably mountable relative to the apparatus body through the opening;

an outlet through which the developer is discharged from the developer container to an outside of the developer container;

a first shutter to open and close the outlet;

a cover member to open and close the opening of the apparatus body;

a movable member reciprocally movable in forward and reverse directions; and a transmission member to transmit action of the cover member to the movable member, the transmission member disposed between the cover member and the movable member, wherein, when the movable member is moved in the forward direction, the first shutter is closed, and when the movable member is moved in the reverse direction, the first shutter is opened, and wherein, in a terminal period of an opening operation of the cover member, a movement direction of the movable member is reversed from the forward direction to the reverse direction.

2. The image forming apparatus of claim 1, wherein, by transmitting the opening operation of the cover member to the movable member via the transmission member, the movable member is moved in the forward direction to close the first shutter and accumulate an urging force, and when the cover member is closed, the movable member is moved in the reverse direction by the accumulated urging force to open the first shutter.

3. The image forming apparatus of claim 1, wherein the transmission member is connected to each of the cover member and the movable member to rotate the cover member and slide the movable member.

4. The image forming apparatus of claim 3, wherein, when the cover member is opened, the movement direction of the movable member is reversed from the forward direction to the reverse direction after a connecting point of the cover member and the transmission member reaches a maximum point of a rotation trajectory of the connecting point.

5. The image forming apparatus of claim 3, wherein the transmission member is a long flexible member.

6. The image forming apparatus of claim 5, further comprising a direction changer to change an extension direction of the transmission member between areas upstream and downstream from the direction changer, the transmission member wound around the direction changer.

7. The image forming apparatus of claim 1, wherein the transmission member includes a plurality of segments.

8. The image forming apparatus of claim 1, wherein the movable member includes a plurality of segments.

9. The image forming apparatus of claim 1, wherein the apparatus body includes a space to encompass a movement trajectory of the transmission member drawn while the cover member is moved from a closed position to a maximum open position.

10. The image forming apparatus of claim 1, further comprising a second shutter to open and close the outlet independently of the first shutter, wherein, when the developer container is mounted to the apparatus body, the second shutter is opened, and when the developer container is removed from the apparatus body, the second shutter is closed.

11. A developer container, comprising:

a developer containing part to contain developer;

an outlet through which the developer is discharged from the developer containing part to an outside of the developer containing part;

a first shutter to open and close the outlet;

wherein the developer container is mountable and removable relative to an apparatus body of an image forming apparatus through an opening of the apparatus body, the image forming apparatus including a cover member to open and close the opening of the apparatus body, a movable member reciprocally movable in forward and reverse directions, and a transmission member to connect the cover member to the movable member, and when the movable member is moved in the forward direction, the first shutter is closed, and when the movable member is moved in the reverse direction, the first shutter is opened, and wherein a movement direction of the movable member is reversed from the forward direction to the reverse direction in a terminal period of an opening operation of the cover member, and the first shutter is maintained in a closed state while the movable member is moved in the reverse direction after the movement direction is reversed.

12. The developer container of claim 11, wherein the first shutter has a contact portion to contact the movable member to open and close the first shutter.

13. The developer container of claim 11, wherein the developer containing part contains toner as the developer.

14. The developer container of claim 11, wherein the developer containing part contains a mixture of toner and carrier particles as the developer.

* * * * *